US008416178B2

(12) United States Patent
Tanaka et al.

(10) Patent No.: US 8,416,178 B2
(45) Date of Patent: Apr. 9, 2013

(54) DISPLAY APPARATUS

(75) Inventors: Yasuhiro Tanaka, Tokyo (JP); Hironobu Isami, Chiba (JP); Haruhisa Iida, Chiba (JP); Hidenori Kikuchi, Chosei (JP); Yukihide Ode, Mobara (JP)

(73) Assignees: Hitachi Displays, Ltd., Chiba-ken (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 0 days.

(21) Appl. No.: 13/200,389

(22) Filed: Sep. 23, 2011

(65) Prior Publication Data

US 2012/0050146 A1 Mar. 1, 2012

Related U.S. Application Data

(60) Continuation of application No. 12/923,403, filed on Sep. 20, 2010, now Pat. No. 8,054,278, which is a division of application No. 11/639,149, filed on Dec. 15, 2006, now Pat. No. 7,821,487.

(30) Foreign Application Priority Data

Dec. 22, 2005 (JP) ..... 2005-369758

(51) Int. Cl.
*G09G 3/36* (2006.01)
*G09G 5/00* (2006.01)

(52) U.S. Cl.
USPC ..... 345/100; 345/204

(58) Field of Classification Search ..... 345/98–100, 345/204, 87, 76, 82; 377/64, 70, 74
See application file for complete search history.

(56) References Cited

U.S. PATENT DOCUMENTS

| | | | |
|---|---|---|---|
| 6,307,681 | B1 | 10/2001 | Aoki et al. |
| 6,580,411 | B1 | 6/2003 | Kubota et al. |
| 7,423,624 | B2 | 9/2008 | Nose |
| 7,518,587 | B2 | 4/2009 | Lee et al. |
| 2004/0189579 | A1 | 9/2004 | Shimizu |

(Continued)

FOREIGN PATENT DOCUMENTS

| | | |
|---|---|---|
| JP | 8-22267 | 1/1996 |
| JP | 11-337910 | 12/1999 |

(Continued)

*Primary Examiner* — Stephen Sherman
(74) *Attorney, Agent, or Firm* — Stites & Harbison PLLC; Juan Carlos A. Marquez, Esq.

(57) ABSTRACT

There is a need for decreasing a variation in times for writing to TFT elements for pixels in a direction along the extension of a gate line in a liquid crystal display apparatus. A display apparatus includes a display panel having multiple gate lines and drain lines arranged in a matrix and a data driver for outputting a display data signal to each drain line. The data driver includes: an internal control signal generation circuit generating an internal control signal for setting a timing to output a data signal to a drain line of each block on a block basis by dividing the plurality of drain lines into multiple blocks; and a register circuit for recording a setting for division of the block, a setting for delay direction and width of a timing to output the data signal, and a setting for rising and falling of an internal control signal.

3 Claims, 35 Drawing Sheets

U.S. PATENT DOCUMENTS

| | | | |
|---|---|---|---|
| 2004/0252032 | A1 | 12/2004 | Netzer |
| 2005/0156842 | A1 | 7/2005 | Kato |
| 2005/0174344 | A1 | 8/2005 | La |
| 2005/0248556 | A1 | 11/2005 | Yoshinaga et al. |
| 2005/0264548 | A1 | 12/2005 | Okamura et al. |
| 2006/0033696 | A1 | 2/2006 | Nakamura et al. |
| 2008/0129675 | A1 | 6/2008 | Tanaka |

FOREIGN PATENT DOCUMENTS

| | | |
|---|---|---|
| JP | 2003-208599 | 7/2003 |
| JP | 2004-289329 | 10/2004 |
| JP | 2004-301946 | 10/2004 |
| JP | 2005-004205 | 1/2005 |
| JP | 2005-189447 | 7/2005 |
| JP | 2005-189758 | 7/2005 |
| JP | 2005-338421 | 12/2005 |

DISPLAY APPARATUS

CROSS REFERENCE TO RELATED APPLICATIONS

This application is a Continuation Application of U.S. application Ser. No. 12/923,403 filed Sep. 20, 2010 now U.S. Pat. No. 8,054,278, which is a Divisional Application of U.S. application Ser. No. 11/639,149 filed Dec. 15, 2006 now U.S. Pat. No. 7,821,487. Priority is claimed based upon U.S. application Ser. No. 12/923,403 filed Sep. 20, 2010, which claims the priority date of U.S. application Ser. No. 11/639,149 filed Dec. 15, 2006, which claims the priority date of Japanese Application JP 2005-369758 filed on Dec. 22, 2005, the content of which is hereby incorporated by reference into this application.

BACKGROUND OF THE INVENTION

1. Field of the Invention

The present invention relates to a display apparatus. More specifically, the invention relates to a technology effectively applied to a liquid crystal display apparatus.

2. Description of Related Art

Conventionally, display apparatuses include a liquid crystal display apparatus using a liquid crystal display panel. The liquid crystal display panel uses a pair of substrates between which a liquid crystal material is sealed. The substrate is provided with multiple gate lines and drain lines in a matrix, for example. Two adjacent gate lines and two adjacent drain lines enclose an area, i.e., one pixel area. Each pixel area contains a TFT element or a pixel electrode.

The liquid crystal display panel displays an image or a video, for example, by supplying each drain line with a display data signal and sequentially supplying each gate line with a scanning signal.

A timing controller and a data driver (drain driver) are used to generate a display data signal input to each drain line and control an input timing. The timing controller and a scanning driver (gate driver) are used to generate a scanning signal input to each gate line and control an input timing.

For example, the data driver includes: a latch circuit for holding display data until it is accumulated to become large enough for one horizontal synchronization period; a level shift circuit for converting a signal level of the display data; a decoder circuit for generating an analog signal (gradation voltage) based on the display data provided with the converted signal level; an output circuit for amplifying the analog signal generated from the decoder circuit; and a switch circuit for outputting the analog signal amplified by the output circuit to a drain line (e.g., see patent document 1).

The level shift circuit is a voltage conversion circuit and is constructed to include two stages, i.e., a low-voltage operating unit and a high-voltage operating unit. The high-voltage operating unit uses a so-called cross-coupled circuit construction that includes, for example, four or six MOS transistors (e.g., see patent document 2).

Recently, there is proposed a method of inserting a black display between display data for the liquid crystal display apparatus so as to improve the moving picture quality (e.g., see patent document 3).

[Patent document 1] Japanese Patent Laid-Open No. 2004-301946

[Patent document 2] Japanese Patent Laid-Open No. 2004-289329

[Patent document 3] Japanese Patent Laid-Open No. 2003-208599

However, the inventors found that the conventional liquid crystal display apparatus causes the following problems.

(a) The data driver outputs a display data signal to all drain lines at the same timing. However, the scanning signal causes different waveforms for a pixel near a scanning signal input terminal for the gate line and for a pixel far from the same. There is a variation in times to write display data signals (gradation voltage signals) for TFT elements.

(b) The data driver causes a momentary current at a timing when a horizontal synchronization signal latches data at a time. A power supply voltage fluctuates due to the momentary current to degrade the reliability of the data driver and the display apparatus.

(c) When the scanning driver may include multiple driver ICs, an interval greater than or equal to an interval between chips needs to be provided between the gate line for outputting a scanning signal for the display data and the gate line for outputting a scanning signal for black display insertion. This is because two gate lines connected to the same driver IC cannot be controlled so as to output a scanning signal for display data to one gate line and to output a scanning signal for black data insertion to the other. When multiple driver ICs are cascade-connected, there is a limitation on setting of an interval between the gate line for display data and the gate line for black data insertion.

(d) The driver supplies a very higher voltage to the TFT element than an operating voltage for a logic circuit previous to a shift register and cannot operate with a MOS transistor size for a conventional level shifter circuit. Operating the level shifter requires a MOS transistor double or larger than a conventional one. Accordingly, the driver IC becomes larger.

To be more specific, the problem in (a) occurs for the following reason. While a scanning signal input to the gate line generates a sharp waveform near the input terminal, the waveform becomes duller as the distance from the input terminal increases. Since the conventional data driver outputs a display data signal to respective drain lines at a time, the write timing is set at a point near to or far from the input terminal of the gate line. A write operation becomes insufficient at the near point or the far point. The display quality degrades accordingly.

The following describes the problem in (b) more specifically. The data driver allows the horizontal synchronization signal to output data from a latch circuit at a time. The output data simultaneously drives a level shifter circuit to select a specified gradation voltage for a decoder circuit. At this time, the level shifter circuit applies an electric current equivalent to the number of outputs between the power supply for a high withstand voltage system (high-voltage operating unit) and a ground (GND). Increasing the number of outputs accordingly increases the momentary current and a variation in the power supply voltage. Such problem is remarkable with respect to an onboard liquid crystal display apparatus such as a car navigation system, for example.

SUMMARY OF THE INVENTION

It is an object of the present invention to provide a technology capable of decreasing a variation in times for writing to TFT elements for pixels in a direction along the extension of a gate line in a liquid crystal display apparatus.

It is another object of the invention to provide a technology capable of decreasing a peak value of a momentary current generated in a data driver in a liquid crystal display apparatus and improving reliability of the data driver and the display apparatus.

It is still another object of the invention to provide a technology capable of cascade-connecting multiple scanning driver ICs in a liquid crystal display apparatus and improving the flexibility of combining a gate line to output a scanning signal for display data with a gate line to output a scanning signal for black data insertion.

It is yet another object of the invention to provide a technology capable of allowing a conventionally sized MOS transistor to operate a level shifter circuit in a liquid crystal display apparatus.

These and other objects and novel features of the invention may be readily ascertained by referring to the following description and appended drawings.

An overview of the invention to be disclosed in this application will be described as follows.

(1) There is provided a display apparatus including a display panel having a plurality of gate lines and a plurality of drain lines arranged in a matrix, a scanning driver for outputting a scanning signal to each gate line, a data driver for outputting a display data signal to each drain line, and a display control circuit for controlling a timing to output a scanning signal from the scanning driver and a timing to output a data signal from the data driver. The data driver includes: an internal control signal generation circuit for generating an internal control signal for setting a timing to output a data signal to a drain line of each block on a block basis based on a horizontal synchronization clock from the display control circuit by dividing the plurality of drain lines into a plurality of blocks; and a register circuit for recording a setting for division of the block, a setting for a delay direction and a delay width of a timing to output the data signal, and a setting for rising and falling of an internal control signal. The data driver has a function of outputting the output signal on a block basis.

(2) In the display apparatus according to (1) above, the internal control signal generation circuit delays a timing to output the data signal from a block near an input terminal for the scanning signal to a block far therefrom along the gate line.

(3) In the display apparatus according to (1) or (2) above, the data driver includes a plurality of driver ICs connected to a common bus wiring. Each of the driver ICs includes the internal control signal generation circuit and the register circuit. The display control circuit generates, for each of the driver ICs, register data containing a setting for division of the block, a setting for a delay direction and a delay width of a timing to output the data signal, and a setting for rising and falling of an internal control signal and outputs the register data to each driver IC. Each of the driver ICs generates an internal control signal based on input register data allocated to itself.

(4) In the display apparatus according to (3) above, each of the driver ICs has address information for identifying itself. The display control circuit generates register data containing the address information and outputs the register data to each driver IC.

(5) In the display apparatus according to (3) above, each of the driver ICs reads register data allocated to the driver IC itself and, after completion of reading, transfers a carry signal to a driver IC at a next stage.

(6) A display apparatus comprising a display panel having a plurality of gate lines and a plurality of drain lines arranged in a matrix, a scanning driver for outputting a scanning signal to each gate line, a data driver for outputting a display data signal to each drain line, and a display control circuit for controlling a timing to output a scanning signal from the scanning driver and a timing to output a data signal from the data driver, The data driver includes: a data latch circuit for temporarily holding display data; a first latch circuit for holding display data supplied from the data latch circuit in a time-sharing manner until display data is accumulated to become large enough for one horizontal synchronization period; a second latch circuit for holding display data large enough for the one horizontal synchronization period; a level shifter circuit for receiving display data held in the second latch circuit and converts a signal level of the display data; a decoder circuit for generating an analog signal corresponding to the display data signal level converted in the level shifter circuit; an output circuit for amplifying an analog signal generated in the decoder circuit; a switch circuit for outputting an analog signal amplified in the output circuit to a drain line; and a horizontal synchronization signal delay circuit for dividing the plurality of drain lines into a plurality of blocks and shifting a timing to transfer the display data for each block when the second latch circuit transfers the display data to the level shifter.

(7) In the display apparatus according to (6) above, the second latch circuit includes a latch circuit and a multiplexer circuit. The horizontal synchronization signal delay circuit includes a delay circuit for the latch circuit and a delay circuit for the multiplexer circuit.

(8) In the display apparatus according to (6) or (7) above, the horizontal synchronization signal delay circuit gradually delays a timing to transfer the display data from a block near a center of the drain line along an arrangement direction to a block at an end.

(9) A display apparatus comprising a display panel having a plurality of gate lines and a plurality of drain lines arranged in a matrix, a scanning driver for outputting a scanning signal to each gate line, a data driver for outputting a display data signal to each drain line, and a display control circuit for controlling a timing to output a scanning signal from the scanning driver and a timing to output a data signal from the data driver. The scanning driver includes a plurality of driver ICs. Each driver IC includes a first shift register circuit for display data control, a second shift register circuit for black data insertion, and a selector switch circuit for selecting an output from the first shift register circuit or an output from the second shift register.

(10) In the display apparatus according to (9) above, the scanning driver includes: a level shifter circuit for receiving an output from the first or second shift register circuit and converting a signal level of the received output; and a latch circuit for converting an output signal from the level shifter circuit into an output signal having three different voltage levels between the selector switch circuit and the level shifter circuit.

(11) In the display apparatus according to (9) or (10) above, the driver ICs are cascade-connected.

(12) A display apparatus comprising a display panel having a plurality of gate lines and a plurality of drain lines arranged in a matrix, a scanning driver for outputting a scanning signal to each gate line, a data driver for outputting a display data signal to each drain line, and a display control circuit for controlling a timing to output a scanning signal from the scanning driver and a timing to output a data signal from the data driver. The scanning driver includes a level shifter circuit for converting a signal level of an output signal from a shift register circuit. The level shifter circuit includes a first circuit unit operating on a low-voltage power supply and a second circuit unit operating on a high-voltage power supply. The first circuit unit includes a latch circuit for temporarily holding an input signal. The second circuit unit includes at least two P-channel MOS transistors and two N-channel MOS transistors. A first N-channel MOS transistor allows a gate electrode to be connected with a first output terminal of the first circuit unit and allows a drain electrode to be connected with a drain electrode of a first P-channel MOS transistor and with a gate electrode of a second P-channel MOS transistor. A second N-channel MOS transistor allows a gate electrode to be connected with a second output terminal of the first circuit unit and allows a drain electrode to be connected with a drain electrode of a second P-channel MOS transistor and with a gate electrode of a first P-channel MOS transistor.

(13) In the display apparatus according to (12) above, the first circuit unit includes a third P-channel MOS transistor, a third N-channel MOS transistor, a fourth N-channel MOS transistor, and a fifth N-channel MOS transistor. The third P-channel MOS transistor allows a gate electrode to be connected with an input terminal for an input signal based on an output from the shift register circuit and a first enable signal. The third N-channel MOS transistor allows a gate electrode to be connected with an input terminal for a second enable signal and allows a drain electrode to be connected with a drain electrode of the third P-channel MOS transistor and a gate electrode of the fourth N-channel MOS transistor via a NOT gate. The fourth N-channel MOS transistor allows a source electrode to be connected with a drain electrode of the third P-channel MOS transistor. The fifth N-channel MOS transistor allows a gate electrode to be connected with an input terminal of a third enable signal and allows a drain electrode to be connected with a drain electrode of the fourth N-channel MOS transistor. The first output terminal is connected with a drain electrode of the third P-channel MOS transistor. The second output terminal is connected, via a NOT gate, with a stage subsequent to a node between a drain electrode of the third P-channel MOS transistor and a source electrode of the fourth N-channel MOS transistor.

(14) In the display apparatus according to (13) above, a differential amplifier circuit generates the second and third enable signals.

A display apparatus according to the invention complies with the above-mentioned means (1) through (5) with respect to the construction of the data driver and control data input to the data driver so as to decrease a variation in times for writing to TFT elements for pixels in a direction along the extension of a gate line. According to means (1), the data driver generates the internal control signal and outputs a display data signal to each block at a different timing. When the display data signal is output to a drain line of each block, an output timing is delayed for a block far from an input terminal of a gate line as mentioned in means (2), for example. This makes it possible to ensure alignment between a time to write to a TFT element for a pixel near an input terminal causing a sharp waveform of the scanning signal and a time to write to a TFT element for a pixel far from the input terminal. It is possible to prevent the display quality from degrading due to a variation in write times.

When the data driver includes multiple driver ICs connected to a common bus wiring, each driver IC may be collectively supplied with register data needed for the internal control signal setting on a driver IC basis as described in means (3), for example. When each driver IC has address information, the register data may be processed as described in means (4). When each driver IC has no address information, the register data may be processed as described in means (5).

The display apparatus allows the data driver to be constructed as described in the above-mentioned means (6) through (8) so as to decrease a peak value of a momentary current generated in the data driver and improve reliability of the data driver and the display apparatus. The second latch circuit transfers display data in multiple blocks to the level shifter circuit more than once. The second latch circuit is constructed as described in means (7), for example. The display data is transferred as described in means (8), for example. This makes it possible to disperse a momentary current generated by driving the level shifter circuit and decrease a peak value. Accordingly, it is possible to improve the reliability of the data driver and the display apparatus.

The display apparatus according to the invention allows the scanning driver to be constructed as described in means (9) so as to cascade-connect multiple scanning drivers and output a scanning signal for black data insertion to any gate line. This makes it possible to simultaneously output a scanning signal for display data and a scanning signal for black data insertion to different gate lines connected to the same driver IC. Means (10) can extend the time to incorporate data and further improve the display quality. The construction according to means (9) and (10) can cascade-connect multiple driver ICs as described in means (11).

The display apparatus allows the level shifter circuit to be constructed as described in means (12) so as to enable a conventionally sized MOS transistor to operate the level shifter circuit. In this case, the first circuit unit is constructed as described in means (13) and (14). This makes it possible to minimally size the MOS transistor in the first circuit unit and eliminate the need to apply an electric current for inversion. Accordingly, it is possible to save a consumption current and operate the level shifter circuit without increasing the MOS transistor size.

BRIEF DESCRIPTION OF THE DRAWINGS

Exemplary embodiments of the present invention will be described in detail based on the following figures, wherein.

DETAILED DESCRIPTION OF THE PREFERRED EMBODIMENTS

Figure 1:
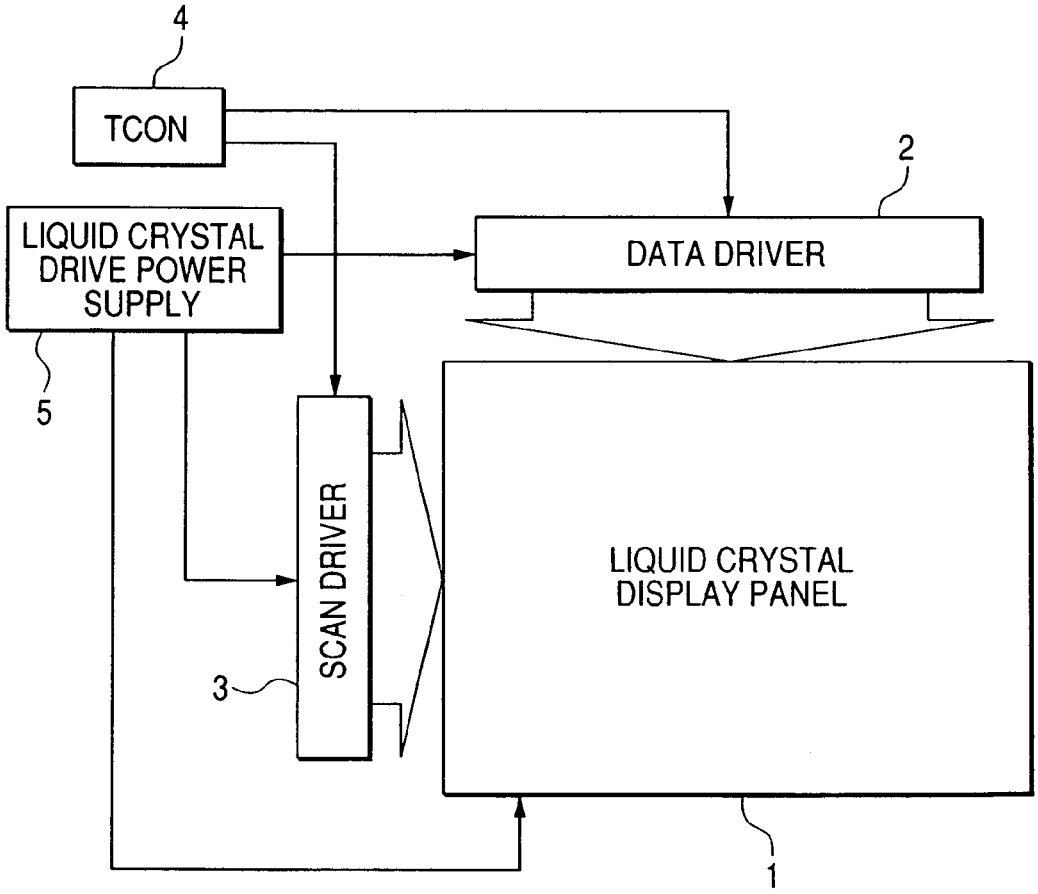
FIG. 1 is a schematic diagram showing the overview construction of a display apparatus according to the invention and a block diagram showing a construction example of a liquid crystal display apparatus.

Embodiments (examples) of the present invention will be described in further detail with reference to the accompanying drawings.

In all diagrams for illustrating the embodiments, parts or components having the same function are depicted by the same reference numerals and a repetitive description is omitted for simplicity.

Figure 2:
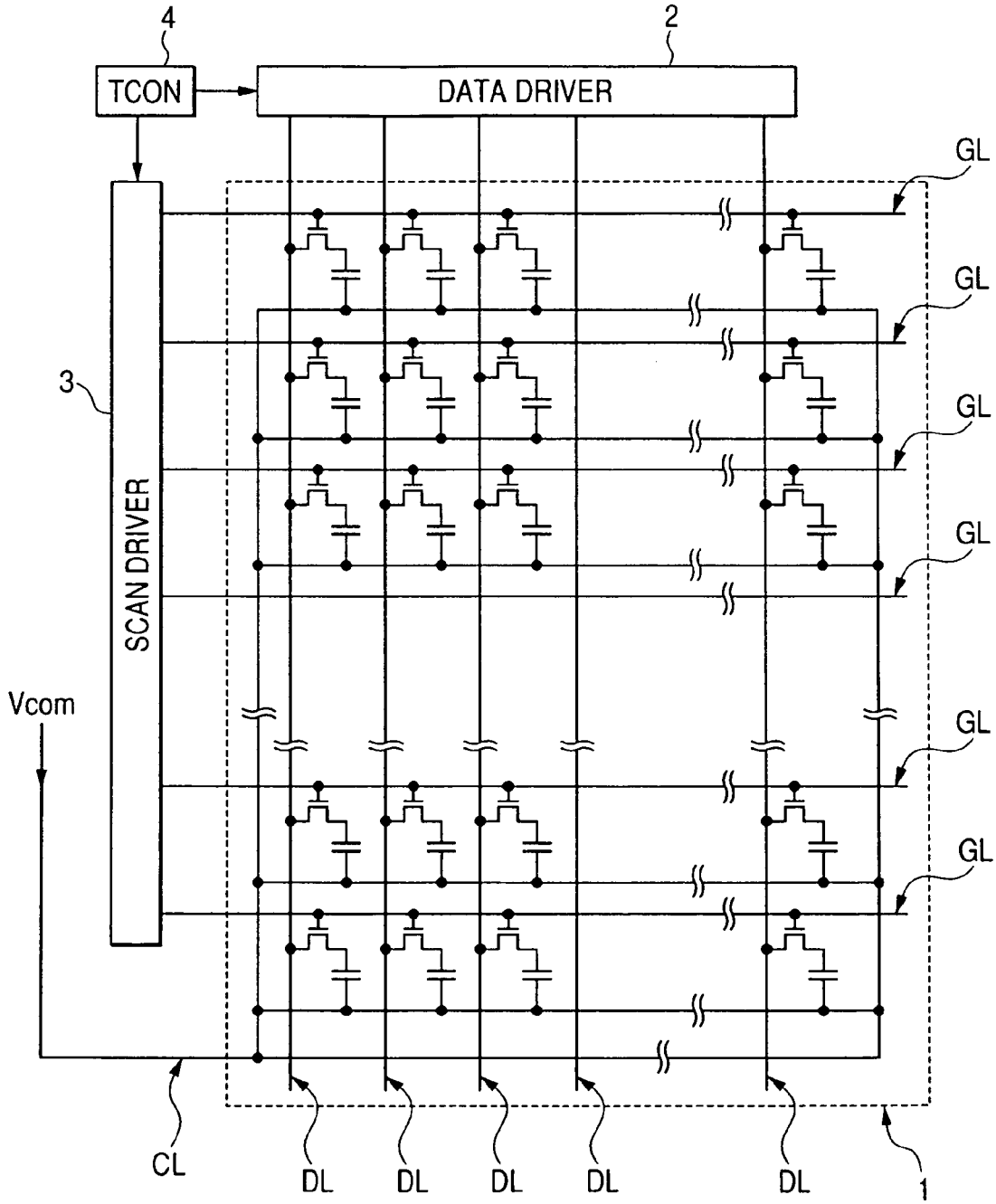
FIG. 2 is a schematic diagram showing the overview construction of a display apparatus according to the invention and a circuit diagram showing the construction of a liquid crystal display panel.
Figure 3:
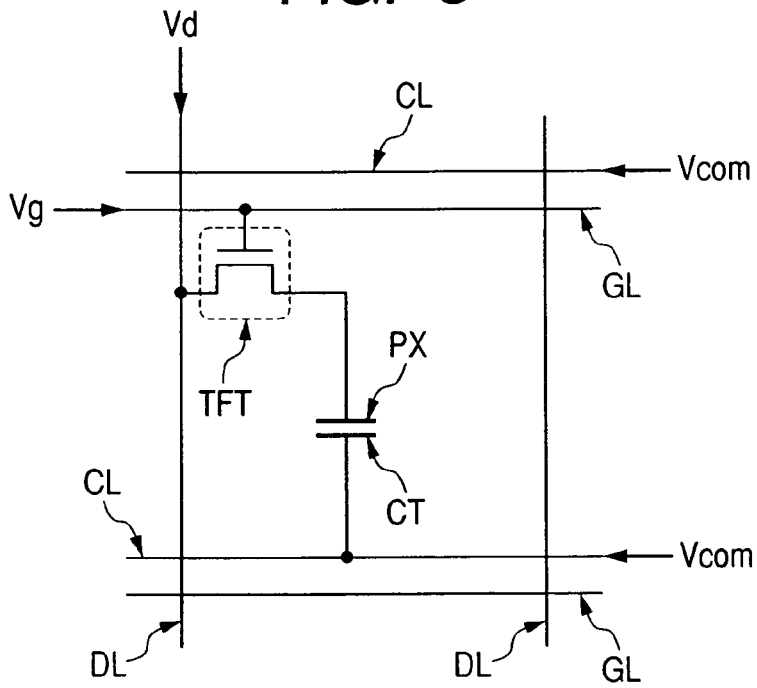
FIG. 3 is a schematic diagram showing the overview construction of a display apparatus according to the invention and illustrates the construction and operations of one pixel.

FIGS. 1 through 3 are schematic diagrams showing an overview construction of a display apparatus according to the invention. FIG. 1 is a block diagram showing a construction example of a liquid crystal display apparatus. FIG. 2 is a circuit diagram showing the construction of a liquid crystal display panel. FIG. 3 illustrates the construction and operations of one pixel.

As shown in FIG. 1, for example, the display apparatus according to the invention is a liquid crystal display apparatus including an liquid crystal display panel 1, a data driver 2, scanning driver 3, a timing controller 4, and a liquid crystal drive power supply 5.

As shown in FIGS. 2 and 3 for example, the liquid crystal display panel 1 is provided with multiple drain lines DL and gate lines GL in a matrix. Each drain line DL is connected to the data driver 2. Each gate line GL is connected to the scanning driver 3. In the liquid crystal display panel 1, two adjacent drain lines DL and two adjacent gate lines GL enclose an area, i.e., one pixel area. Each pixel area includes a TFT element, a pixel electrode PX, and a common electrode CT. A gate electrode of the TFT element connects with one gate line GL. A drain electrode connects with one drain line DL. A source electrode of the TFT element connects with the pixel electrode PX. A capacitor element is formed between the pixel electrode PX and the common electrode CT connected to a common signal line CL.

When the liquid crystal display panel 1 displays an image, the data driver 2 outputs a display data signal to each drain line DL. The scanning driver 3 sequentially outputs a scanning signal to each gate line GL. The timing controller 4 controls timings of signals output from the data driver 2 and the scanning driver 3.

Embodiment 1

Figure 4:
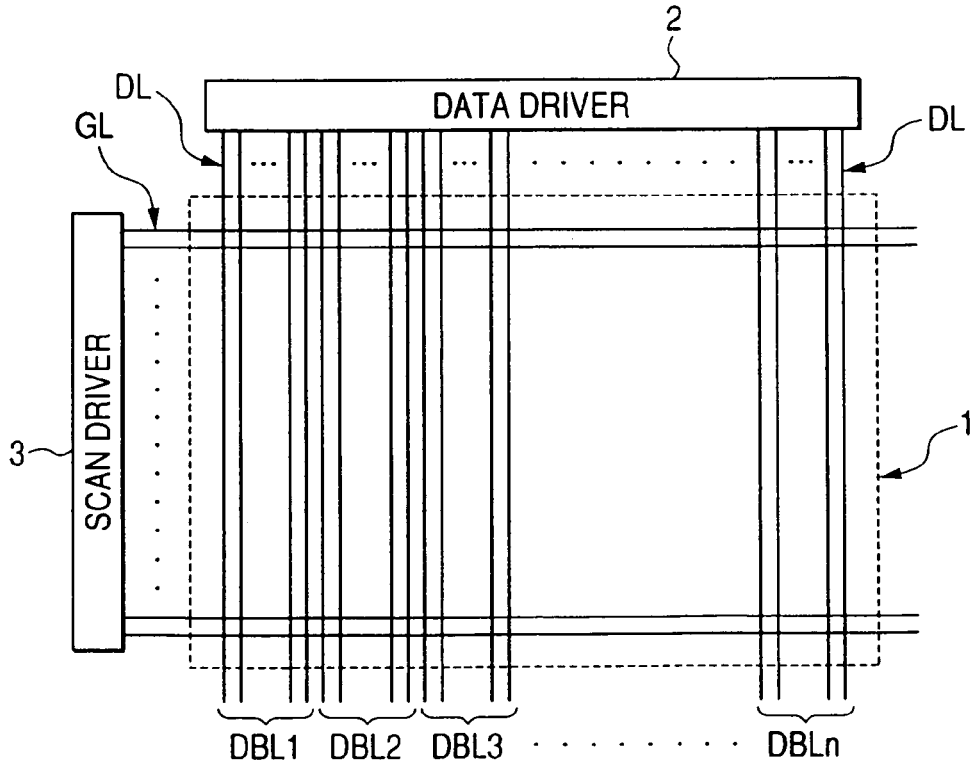
FIG. 4 is a schematic diagram illustrating the operational principle of a liquid crystal display apparatus according to embodiment 1 of the invention and illustrates a method of dividing a drain line.
Figure 5:
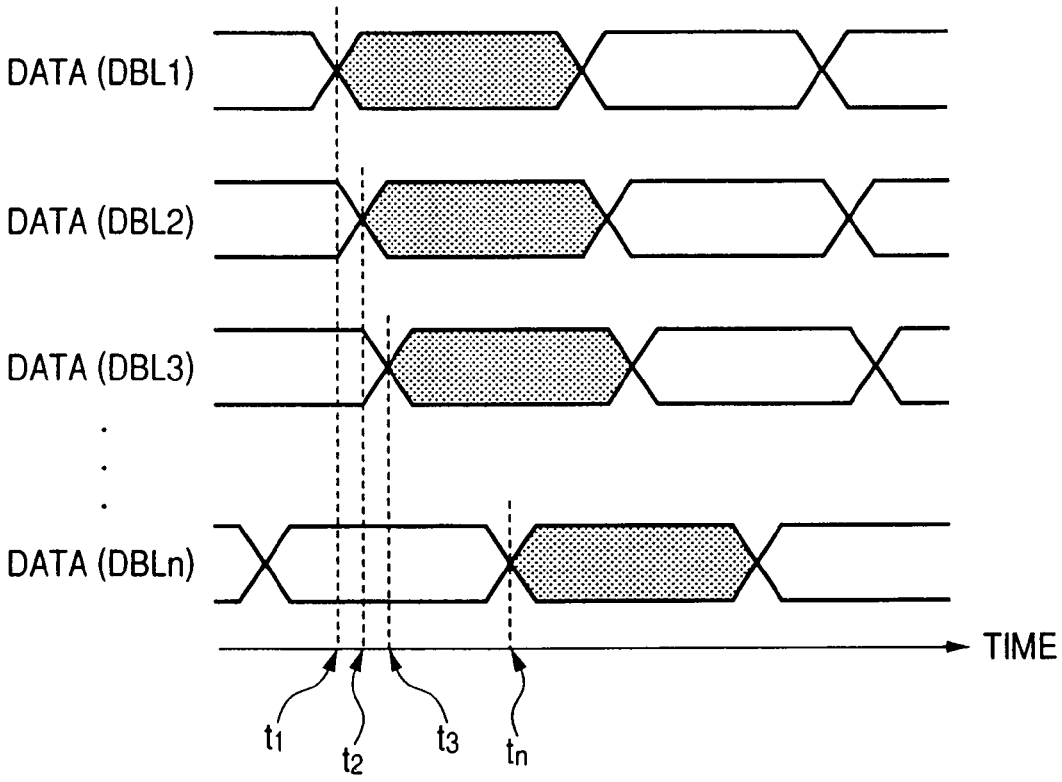
FIG. 5 is a schematic diagram illustrating the operational principle of the liquid crystal display apparatus according to embodiment 1 of the invention and illustrates a method of outputting display data.
Figure 6:
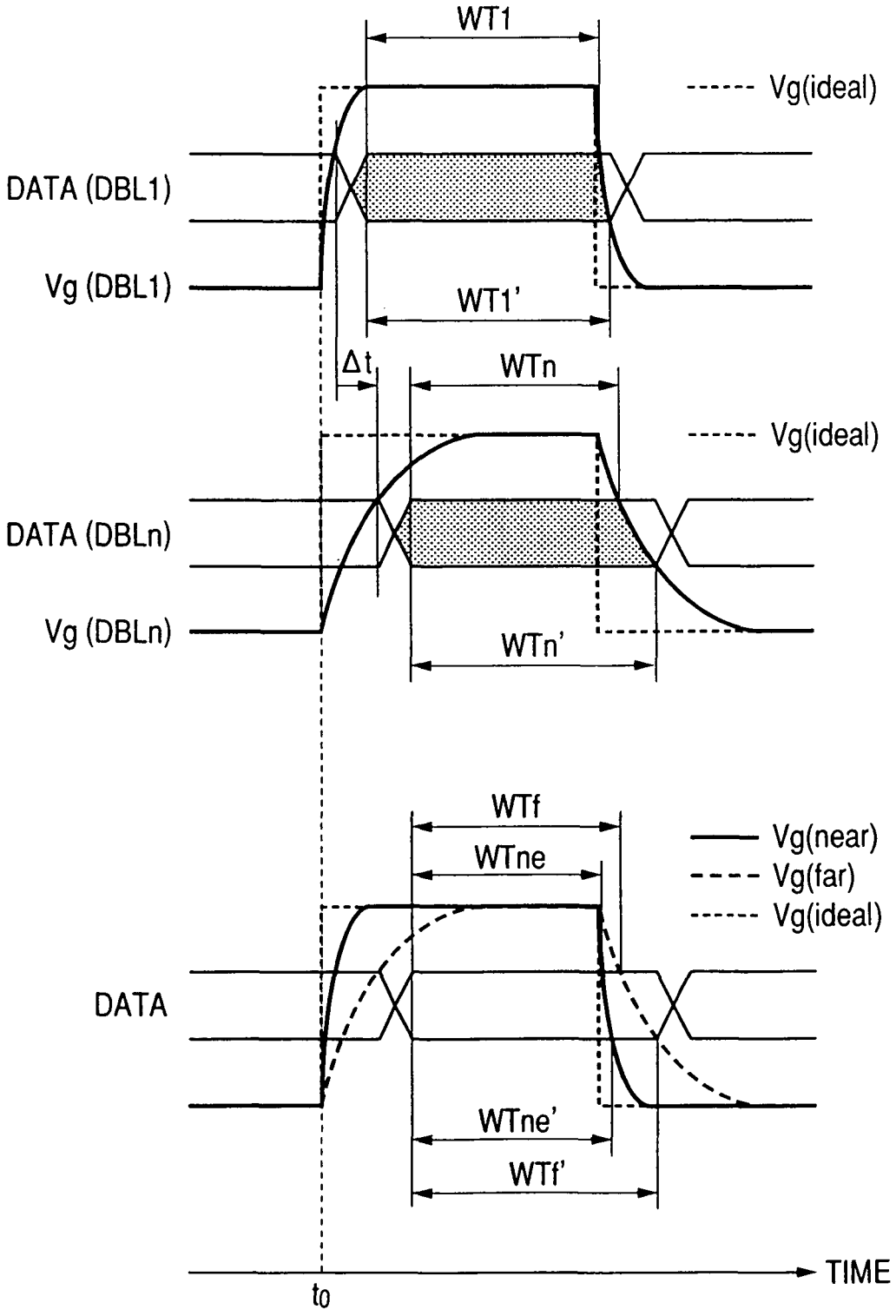
FIG. 6 is a schematic diagram illustrating the operational principle of the liquid crystal display apparatus according to embodiment 1 of the invention and illustrates a method of setting a delay amount.

FIGS. 4 through 6 are schematic diagrams for illustrating the operational principle of the liquid crystal display apparatus according to embodiment 1 of the invention. FIG. 4 illustrates a method of dividing a drain line. FIG. 5 illustrates a method of outputting display data. FIG. 6 illustrates a method of setting a delay amount.

The liquid crystal display apparatus according to embodiment 1 aims at preventing a variation in times to write data to the TFT element of each pixel arranged in a direction along the extension of the gate line in liquid crystal display panel 1. As shown in FIG. 4, for example, the liquid crystal display apparatus is constructed to divide multiple drain lines DL provided for the liquid crystal display panel 1 into multiple blocks DBL1 through DBLn. When the data driver 2 outputs a display data signal (gradation voltage signal) to the drain lines DL, the data driver 2 shifts a timing for output to the blocks DBL1 through DBLn as shown in FIG. 5, for example. Specifically, as shown in FIG. 5, output timings are delayed from the block DBL1 nearest to the input terminal (scanning driver 3) for the gate line GL to the farthest block DBLn.

When the display data signal is output with a timing delay, a delay amount (delay time) is settled based on the degree of dullness attributed to the waveform of a scanning signal on the gate line GL at the blocks DBL2 through DBLn. When a scanning signal is input to the gate line GL, the scanning signal ideally generates a square waveform similar to waveform Vg (ideal) indicated by a dotted line in FIG. 6, for example. When the scanning signal is output from the scanning driver 3 to the gate line GL, the waveform becomes dull by the time it reaches the area of each block. As shown in FIG. 6, the waveform Vg (DBL1) of the scanning signal sharply rises and falls at the block DBL1 nearest to the scanning driver 3. As shown in FIG. 6, waveform Vg (DBLn) of the scanning signal dully rises and falls at block DBLn farthest from the scanning driver 3.

As shown at the bottom in FIG. 6, a conventional liquid crystal display apparatus outputs display data signal DATA to all drain lines at the same timing. The liquid crystal display apparatus normally determines timings of the scanning signal and the display data signal in accordance with the relationship between waveform Vg (far) far from the gate and a minimum electric potential for the display data signal DATA so as not to write the next display data signal. Let us assume that write time WTne or WTne' corresponds to an area near the gate where the waveform Vg (near) sharply rises and falls, and that write time WTf or WTf' corresponds to an area far from the gate. In this case, write time WTne or WTne' becomes shorter than write time WTf or WTf'.

The liquid crystal display apparatus according to embodiment 1 determines an output timing for the display data signal DATA (DBL1) corresponding to the block DBL1 in accordance with the relationship between the scanning signal waveform Vg (DBL1) and a minimum electric potential for the display data signal DATA (DBL1). The liquid crystal display apparatus determines an output timing for the display data signal DATA (DBLn) corresponding to the block DBLn in accordance with the relationship between the scanning signal waveform Vg (DBLn) and a minimum electric potential for the display data signal DATA (DBLn). In this manner, as shown in FIG. 6, a difference of □t (seconds) occurs between the time to rewrite the display data signal DATA (DBL1) in the block DBL1 near the gate and the time to rewrite the display data signal DATA (DBLn) in the block DBLn far from the gate. That is, the display data signal is output to the block DBL1 near the gate at a timing for □t (seconds) earlier than the normal to be able to compensate for the lack of the write time in the block DBL1 near the gate. This makes it possible to almost equalize write times WT1 and WT1' in the block DBL1 near the gate with write times WT1 and WT1' in the block DBL1 near the gate. FIG. 6 shows only the block DBL1 nearest to the scanning driver and the block DBLn farthest from the same. Actually, output timings are configured so as to almost equalize times to write display data in all blocks DBL1 through DBLn.

Figure 7:
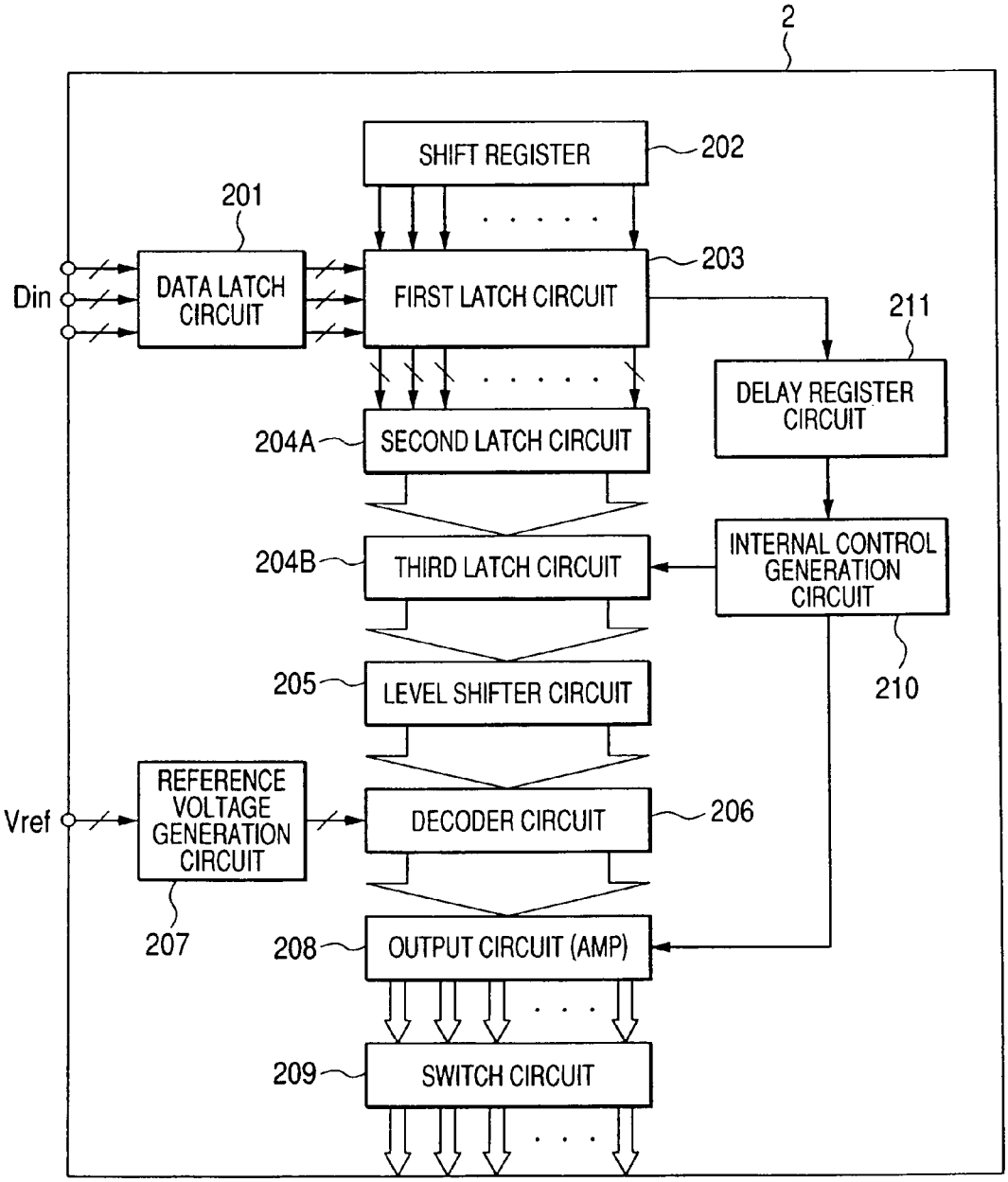
FIG. 7 is a schematic diagram illustrating a data driver in the liquid crystal display apparatus according to embodiment 1 and provides a block diagram showing a construction example of the data driver.
Figure 8:
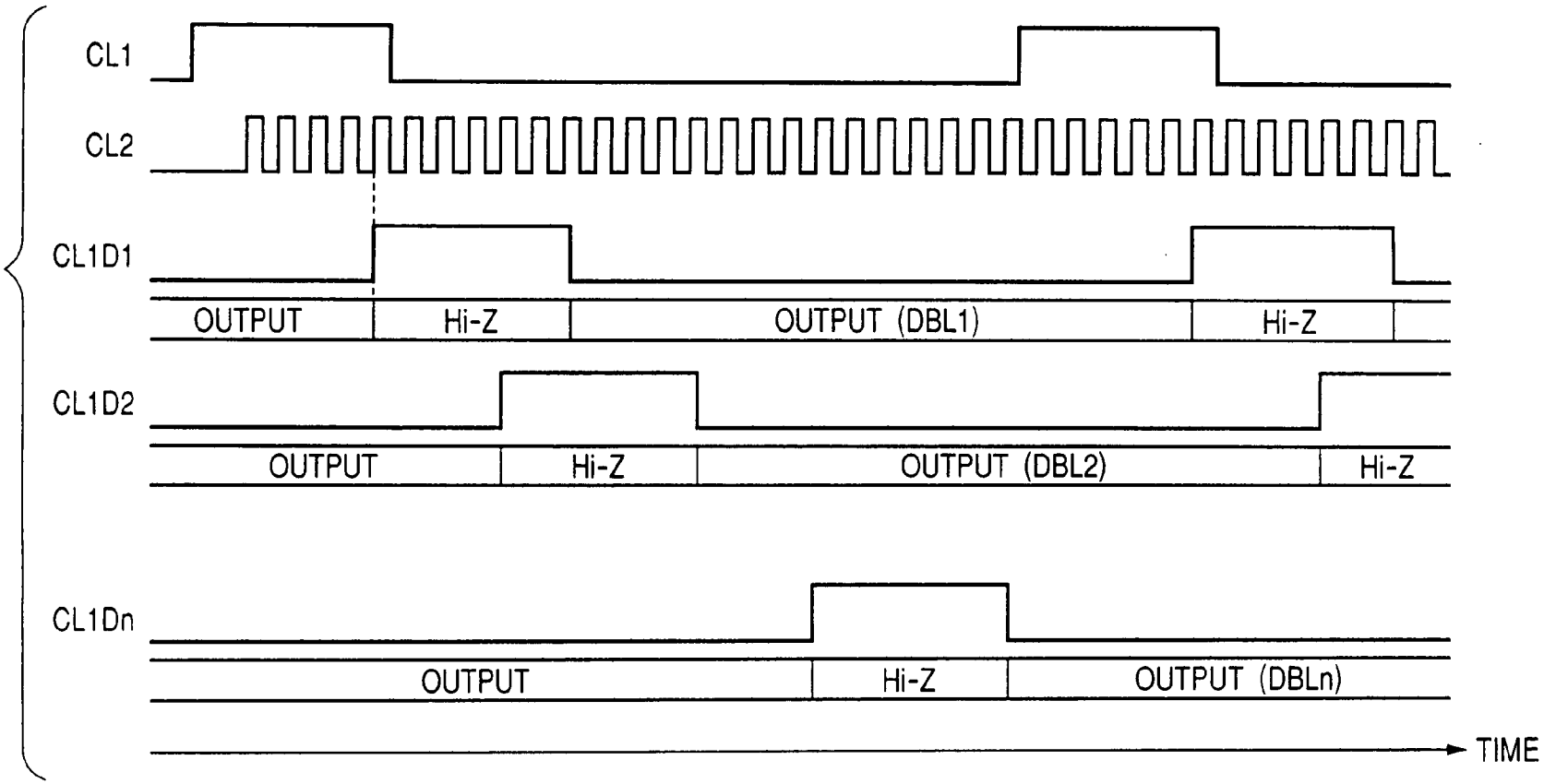
FIG. 8 is a schematic diagram illustrating the construction example and operations of the data driver in the liquid crystal display apparatus according to embodiment 1 and illustrates output timings of display data.
Figure 9:
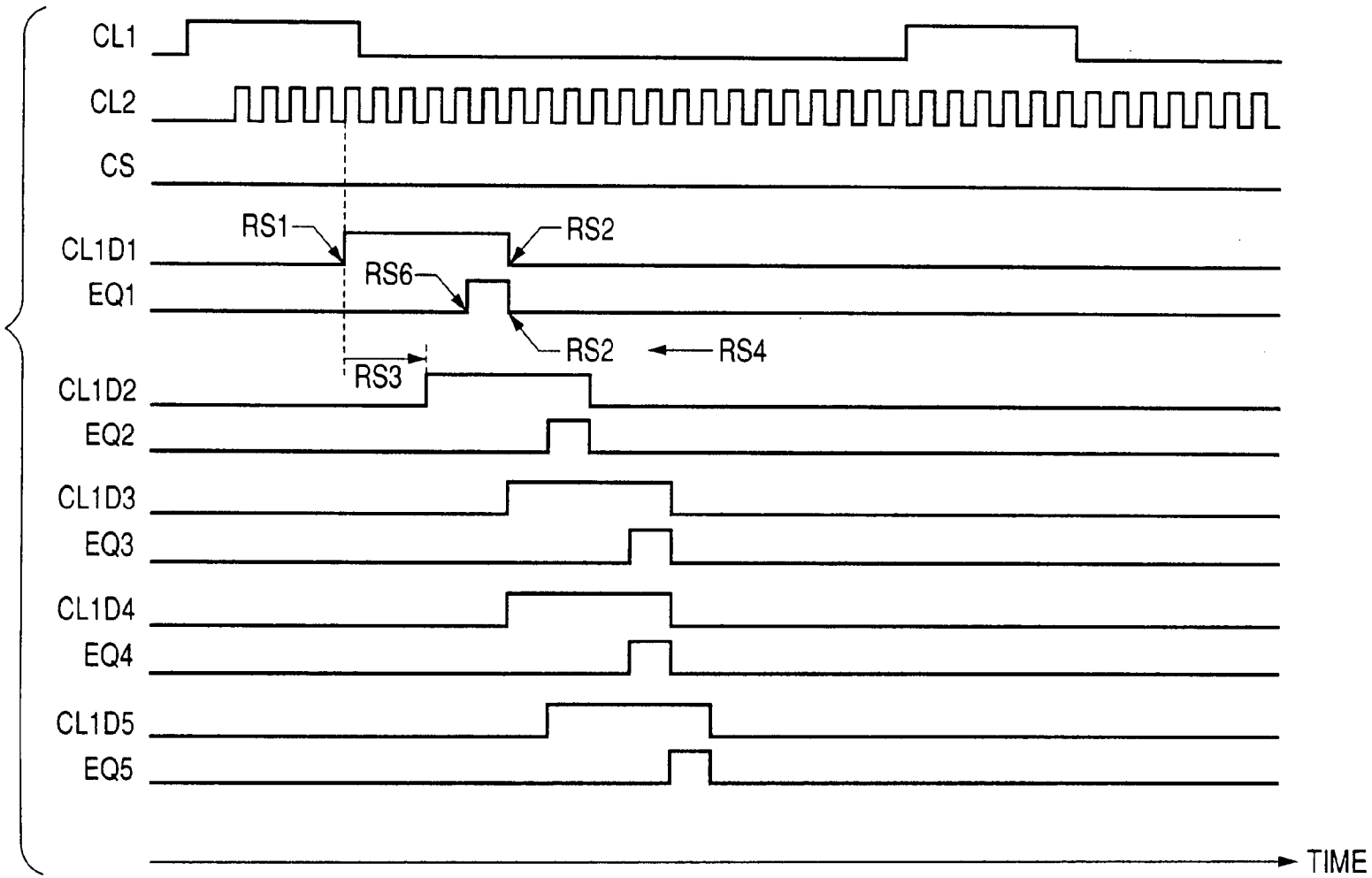
FIG. 9 is a schematic diagram illustrating the construction example and operations of the data driver in the liquid crystal display apparatus according to embodiment 1 and illustrates a method of generating an internal control signal.
Figure 10:
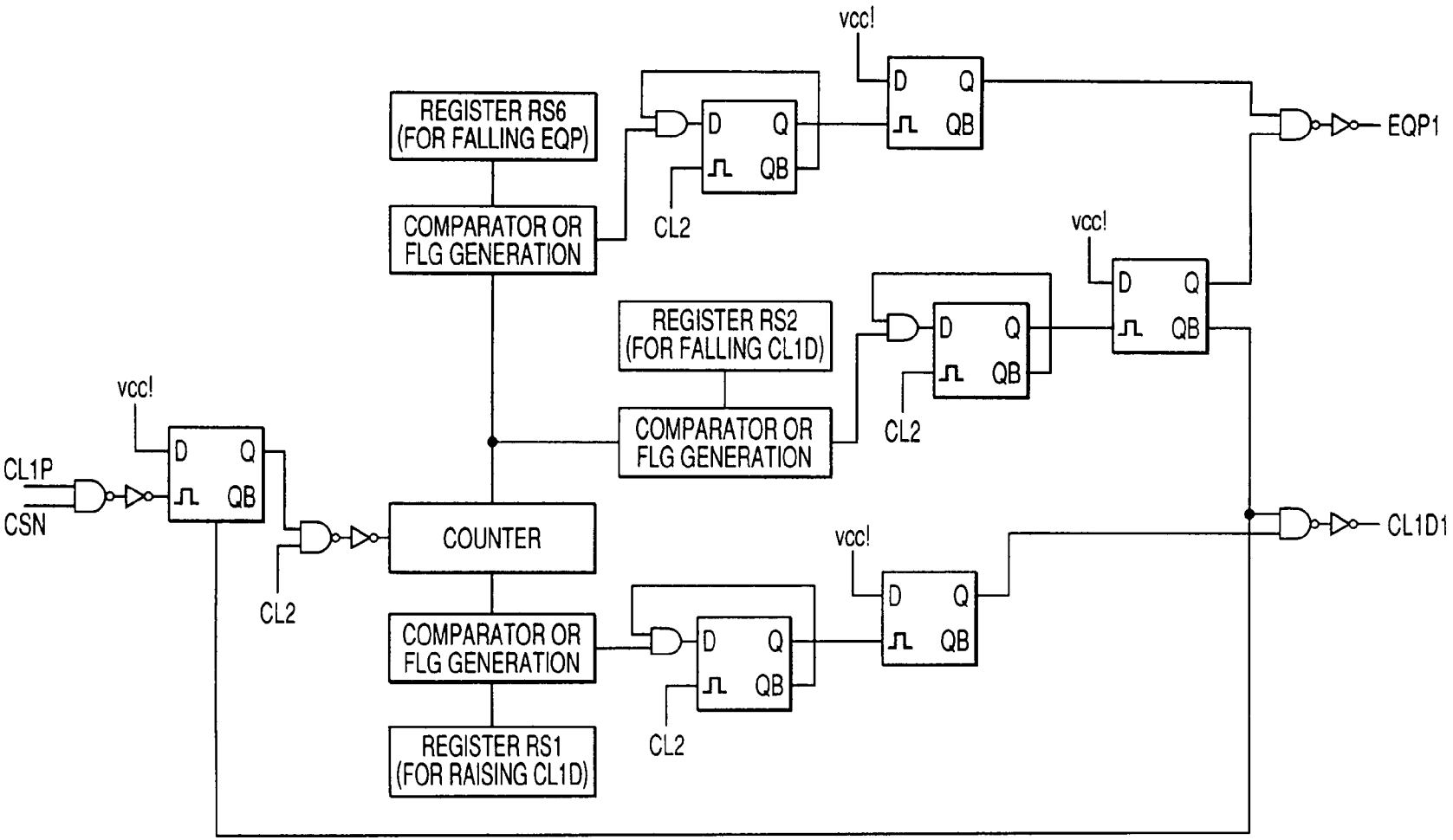
FIG. 10 is a schematic diagram illustrating the construction example and operations of the data driver in the liquid crystal display apparatus according to embodiment 1 and provides a circuit diagram illustrating a construction example of an internal control signal generation circuit at a first stage.
Figure 11:
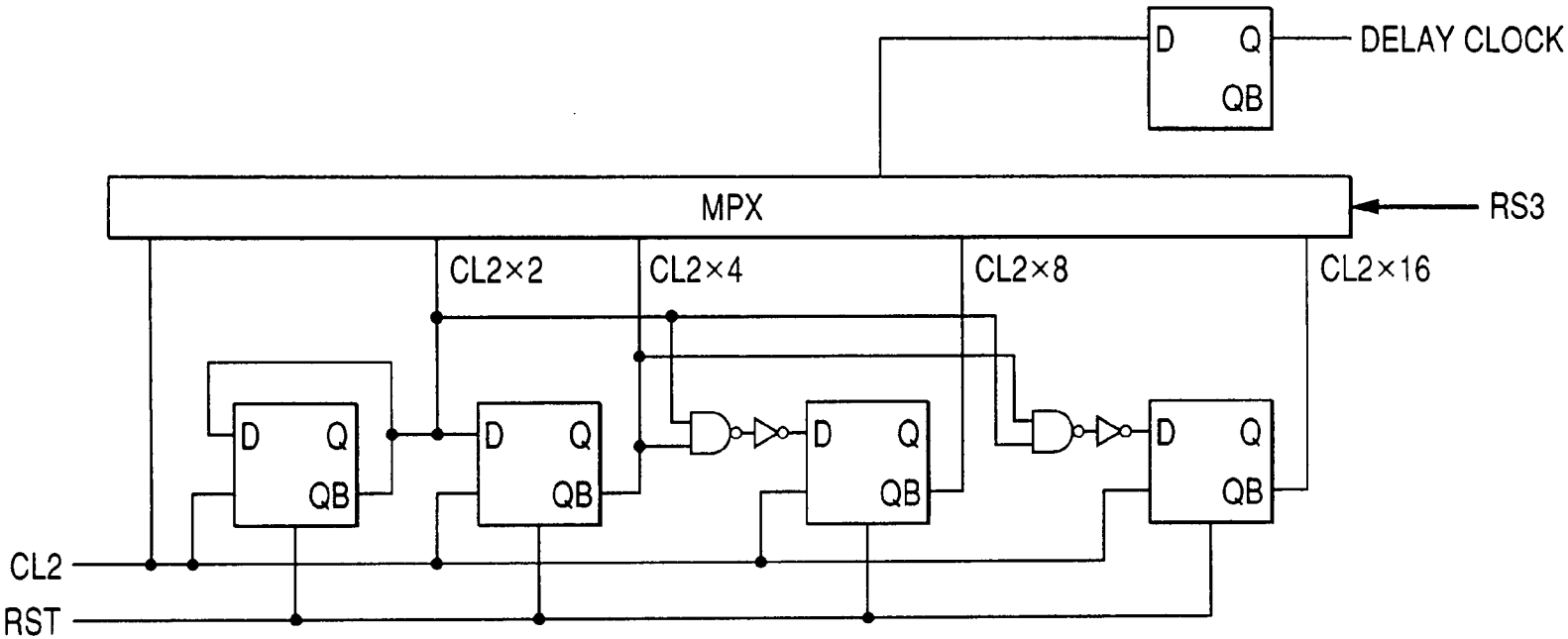
FIG. 11 is a schematic diagram illustrating the construction example and operations of the data driver in the liquid crystal display apparatus according to embodiment 1 and provides a circuit diagram illustrating a construction example of a shift register clock for the internal control signal generation circuit.
Figure 12:
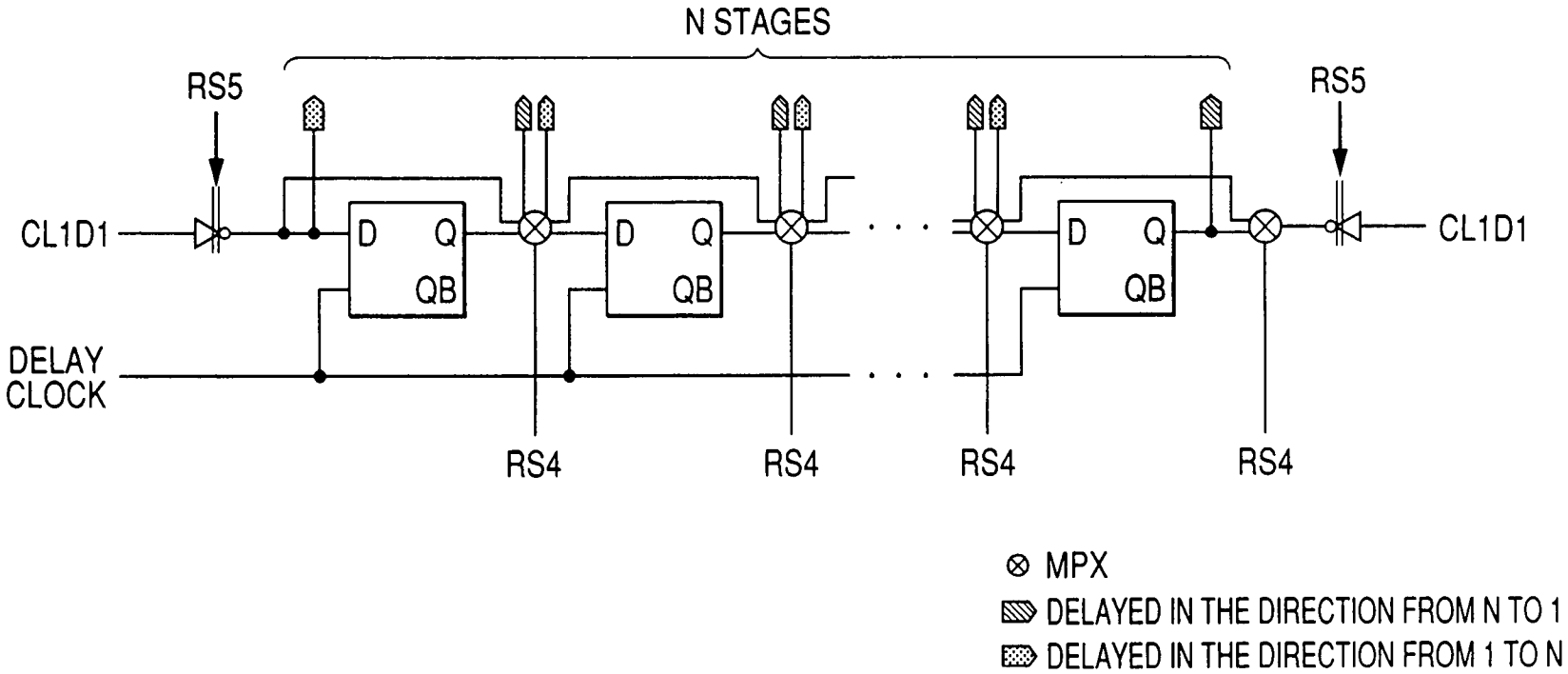
FIG. 12 is a schematic diagram illustrating the construction example and operations of the data driver in the liquid crystal display apparatus according to embodiment 1 and provides a circuit diagram illustrating a construction example of the internal control signal generation circuit at a second stage and later.
Figure 13:
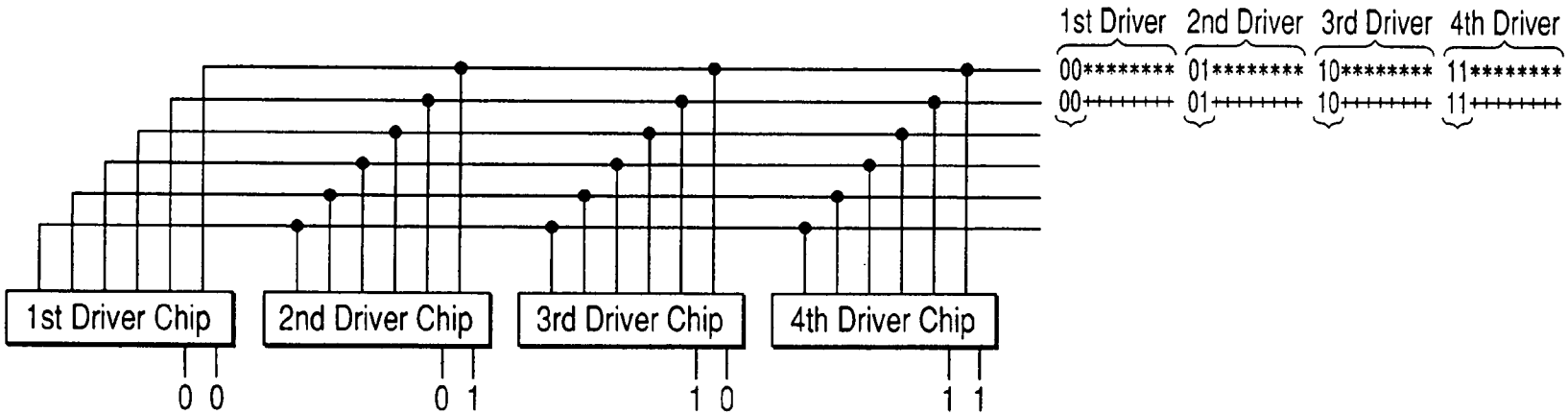
FIG. 13 is a schematic diagram illustrating the construction example and operations of the data driver in the liquid crystal display apparatus according to embodiment 1 and illustrates a method of inputting register data.
Figure 14:
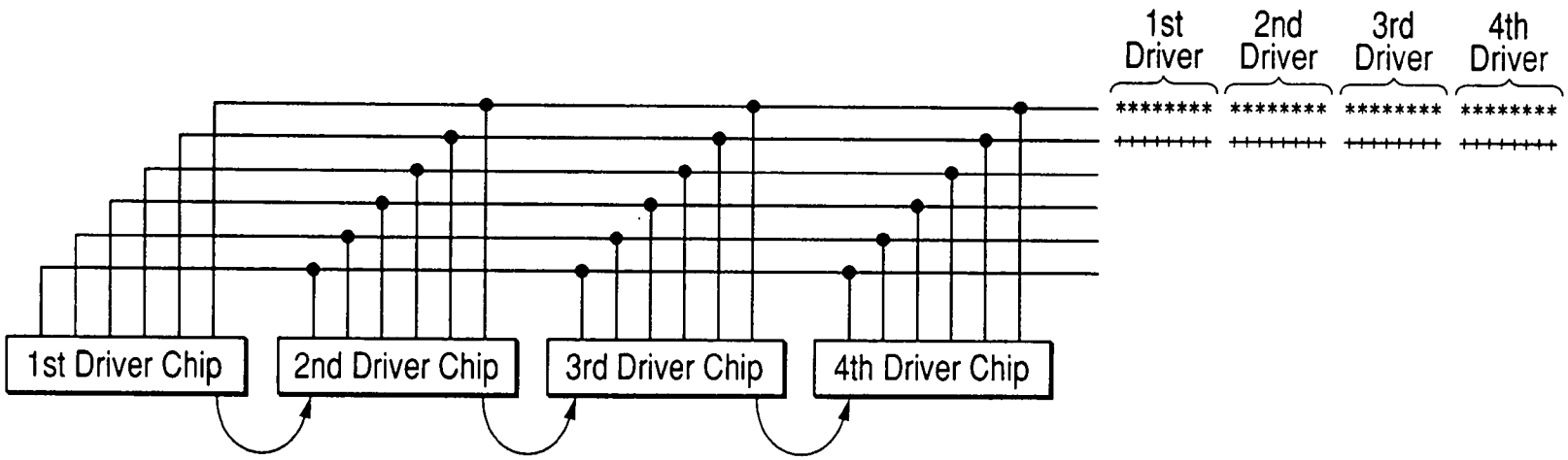
FIG. 14 is a schematic diagram illustrating the construction example and operations of the data driver in the liquid crystal display apparatus according to embodiment 1 and illustrates a method of inputting register data.
Figure 15:
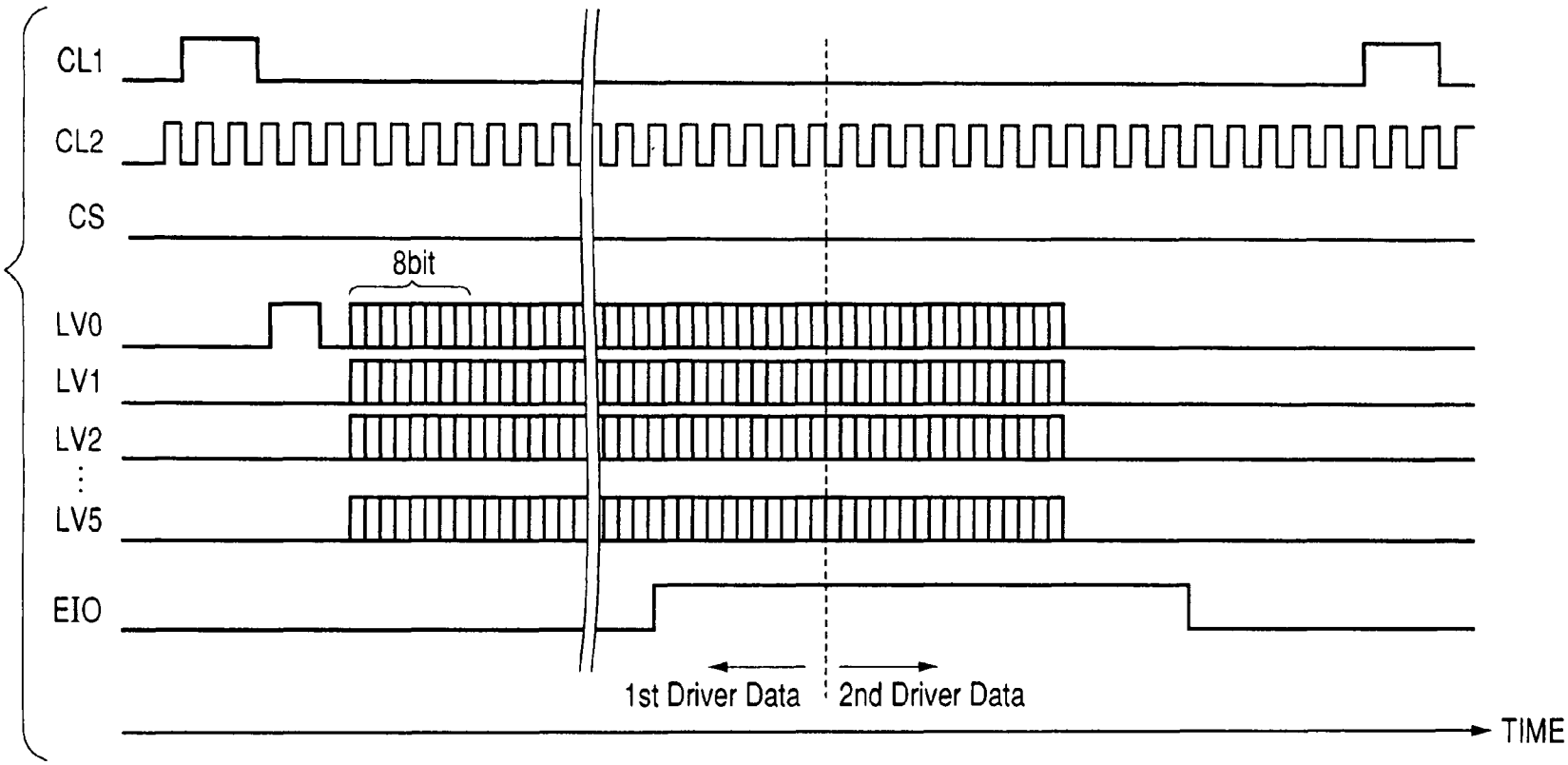
FIG. 15 is a schematic diagram illustrating the construction example and operations of the data driver in the liquid crystal display apparatus according to embodiment 1 and illustrates an input example of register data.
Figure 16:
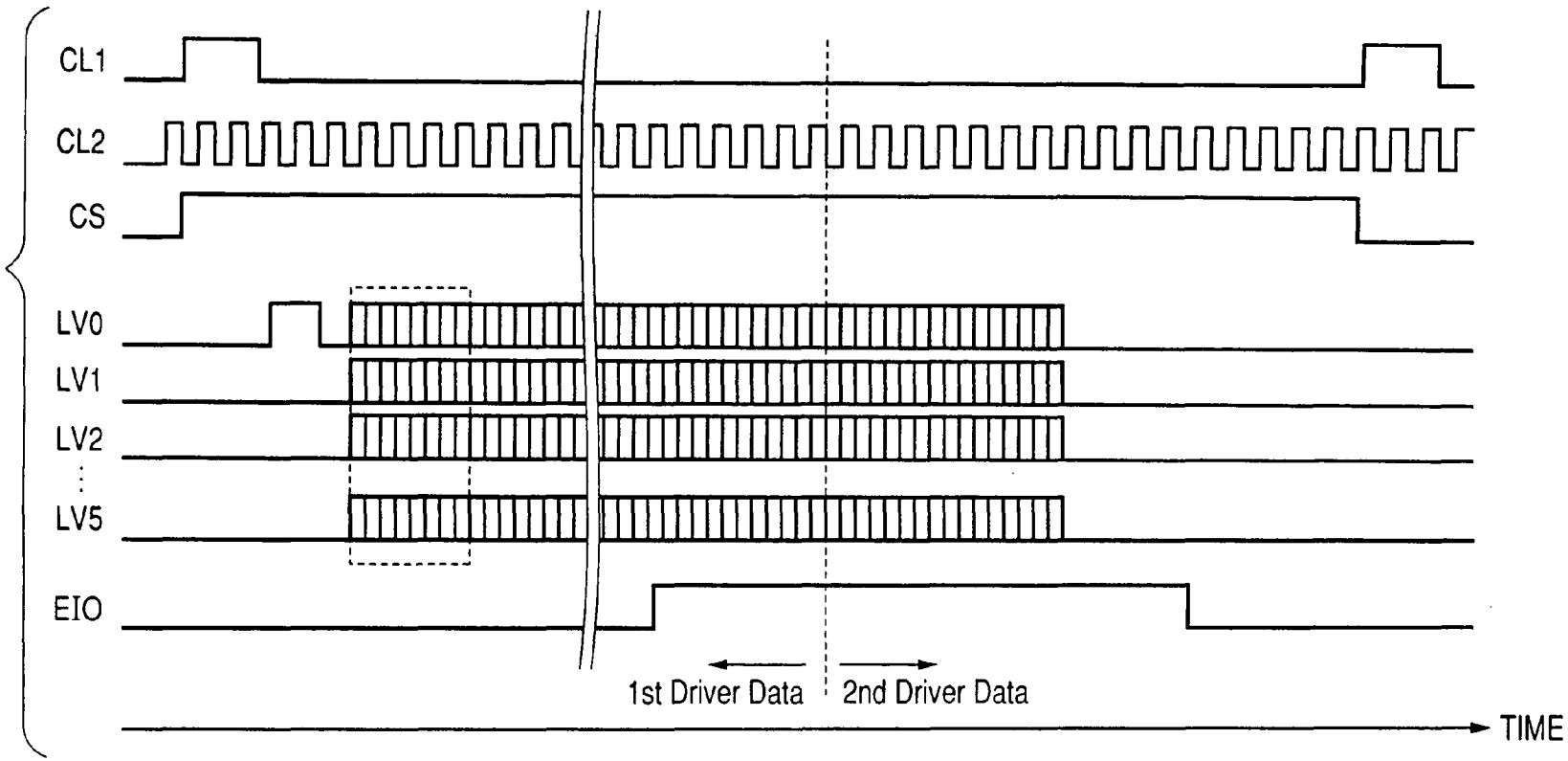
FIG. 16 is a schematic diagram illustrating the construction example and operations of the data driver in the liquid crystal display apparatus according to embodiment 1 and illustrates an input example of register data.
Figure 17:
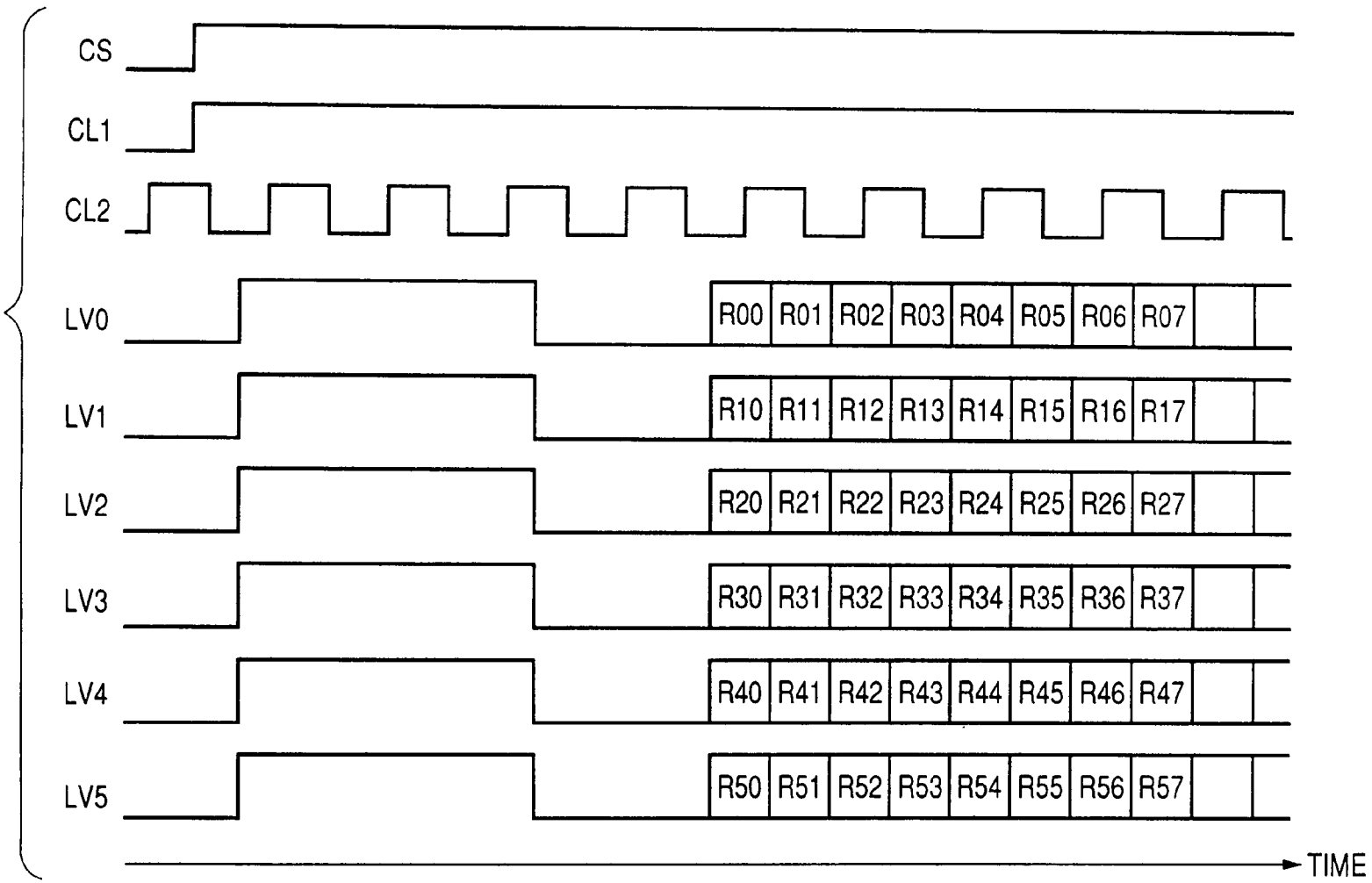
FIG. 17 is a schematic diagram illustrating the construction example and operations of the data driver in the liquid crystal display apparatus according to embodiment 1 and illustrates an input example of register data.

FIGS. 7 through 17 are schematic diagrams illustrating the data driver in the liquid crystal display apparatus according to embodiment 1. FIG. 7 is a block diagram showing a construction example of the data driver. FIG. 8 illustrates output timings of display data. FIG. 9 illustrates a method of generating an internal control signal. FIG. 10 is a circuit diagram illustrating a construction example of an internal control signal generation circuit at a first stage. FIG. 11 is a circuit diagram illustrating a construction example of a shift register clock for the internal control signal generation circuit. FIG. 12 is a circuit diagram illustrating a construction example of the internal control signal generation circuit at a second stage and later. FIGS. 13 and 14 illustrate a method of inputting register data. FIGS. 15 through 17 illustrate an input example of register data.

In the liquid crystal display apparatus according to embodiment 1, for example, the data driver 2 is constructed as shown in FIG. 7 so as to shift (delay) a timing for outputting a display data signal to the drain lines DL corresponding to the blocks DBL1 through DBLn. In the construction of the data driver 2 in FIG. 7, a conventional data driver is also constructed to include a data latch circuit 201, a shift register 202, a first latch circuit 203, a second latch circuit 204A, a third latch circuit 204B, a level shifter circuit 205, a decoder circuit 206, a reference voltage generation circuit 207, an output circuit 208, and a switch circuit 209. In addition to the constituent circuits, the display apparatus according to embodiment 1 also includes an internal control signal generation circuit 210 for generating the internal control signal and a delay register circuit 211 for storing a setting used to generate the internal control signal.

The data driver 2 first allows the data latch circuit 201 to temporarily hold externally input display data and supply the display data in a time-sharing manner to the first latch circuit 203. The first latch circuit 203 holds each display data supplied in a time-sharing manner until the display data is accumulated to become large enough for one horizontal synchronization period. When the display data is accumulated to become large enough for one horizontal synchronization period, the first latch circuit 203 supplies the display data to the second latch circuit 204A. The second latch circuit 204A supplies the held display data to the third latch circuit 204B in accordance with a horizontal synchronization signal. The third latch circuit 204B supplies the display data to the level shifter circuit 205 in accordance with an internal control signal from the internal control signal generation circuit 210. The level shifter circuit 205 converts a signal level of the received display data and supplies the display data to the decoder circuit 206. The decoder circuit 206 generates a gradation voltage signal (analog signal) corresponding to the signal level of the display data based on a reference voltage generated by the reference voltage generation circuit 207 and the display data received from the level shifter circuit 205 and supplies the gradation voltage signal to the output circuit 208.

The first latch circuit 203 supplies the display data to the second latch circuit 204. At the same time, the first latch circuit 203 supplies register data indicating output timings of the blocks DBL1 through DBLn to the delay register circuit 211. Based on the register data, the delay register circuit 211 supplies information needed for setting an output timing to the internal control signal generation circuit 210. Based on the received information, the internal control signal generation circuit 210 generates an internal control signal and supplies it to the third latch circuit 204B and the output circuit 208. For example, CL1D1 through CL1Dn in FIG. 8 represent the generated internal control signals. The internal control signals are provided with the output timings for the blocks DBL1 through DBLn so as to synchronize with clock CL2 generated inside the data driver 2.

The output circuit 208 amplifies the gradation voltage signal received from the decoder circuit 206 and supplies the gradation voltage signal to the switch circuit 209 at a timing configured for each block based on the internal control signal. The switch circuit 209 sequentially outputs the received gradation voltage signals to the drain line DL in order of reception.

When the internal control signal generation circuit 210 generates an internal control signal, the following settings are needed as shown in FIG. 9 for example: setting RS1 for rising of the internal control signals CL1D1 through CL1D5; setting RS2 for falling edges of CL1D1 and EQ1; setting RS3 for delay width; setting RS4 for delay block division; setting RS5 for delay direction; and a setting of equalization signal EQ. For example, a count value of internal clock CL2 is used for register setting to configure the rising setting RS1 and the falling setting RS2 of the internal control signal. The internal clock CL2 is divided to generate a shift register clock that is used to configure setting RS3 for delay width. Setting RS4 for delay block division is given value "1" to enable a delay with reference to the preceding internal control signal or is given value "0" otherwise. Setting RS5 for delay direction specifies the delay direction from the first block DBL1 to the Nth block DBLN or reversely.

The counter circuit generates the internal control signal CL1D1 for the first output block. The shift register generates the remaining internal control signals CL1D2 through CL1D5.

The counter circuit for generating the internal control signal CL1D1 for the first output block and the equalization signal EQP1 and is constructed as shown in FIG. 10. The counter circuit generates the internal control signal CL1D1 and the equalization signal EQP1 from a horizontal synchronization clock CLIP input from the timing controller and the internal clock CL2 using a flip-flop circuit, rising setting RS1 and falling setting RS2 for internal control signals, and falling setting RS6 for equalization signal.

The shift register clock circuit and the shift register circuit generate the remaining internal control signals based on the internal control signal CL1D1 generated by the counter circuit by specifying a delay from the internal control signal CL1D1. The shift register clock circuit is constructed as shown in FIG. 11. The shift register clock circuit generates a delay clock twice, four, eight, or 16 times with one cycle of the internal clock CL2 as a standard.

The shift register circuit is constructed as shown in FIG. 12, for example. The shift register generates the internal control signals CL1D2 through CL1DN for the remaining blocks from the internal control signal CL1D1 generated by the counter circuit, the delay clock generated by the shift register clock circuit, setting RS4 for delay block division, and setting RS5 for delay direction.

The data driver is normally composed of multiple driver ICs (driver chips) DD. As shown in FIGS. 13 and 14, each driver IC DD is connected to common bus wiring. The wiring is collectively supplied with data to be transmitted to the corresponding driver ICs DD. Each driver IC DD needs to be able to identify which of received data is destined for the relevant driver IC. When address information is provided to each driver IC DD for identification as shown in FIG. 13, for example, the address information is attached to the beginning of the data for each driver IC, and then the data is transmitted. Each driver IC DD can read the corresponding data provided with its own address information.

When no address information is provided for each driver IC DD, it is prescribed that each driver IC should start reading data from what number data counting from the first data. When each driver IC DD finishes reading data allocated to it, a carry signal is transferred to the next driver IC as shown in FIG. 14.

With reference to FIGS. 15 through 17, the following describes a method of inputting display data using an interface called mini-LVDS as an example of input interfaces for the data driver.

Normally, the mini-LVDS interface uses six data input lines (common bus wirings). As shown in FIG. 15, the display data is serial data and is transferred from the timing controller 4. A first driver supplies a carry as enable signal EIO to allow a second driver to start incorporating data.

As shown in FIG. 16, for example, a register setup mode is assumed when a CS signal is set to H. First eight bits of the data contain a register setup value needed to generate an internal control signal. A value for the delay register circuit 211 is set based on the register setup value.

FIG. 17 shows how register setup values are written to the beginning of the display data. For example, values are written to eight bits R00 through R07 at the beginning of data transferred on data line LV0. Values are written to eight bits R10 through R17 at the beginning of data transferred on data line LV1. Values are written to eight bits R20 through R27 at the beginning of data transferred on data line LV2. Values are written to eight bits R30 through R37 at the beginning of data transferred on data line LV3. Values are written to eight bits R40 through R47 at the beginning of data transferred on data line LV4. Values are written to eight bits R50 through R57 at the beginning of data transferred on data line LV5. As shown in Table 1, values for setting the delay direction and the delay width are written to eight bits R00 through R07 at the beginning of data transferred on data line LV0. When the delay direction is configured from the first block to the 17th block, "1" is written to data bit R01 transferred on data line LV0 and "0" is written to data bit R02. In terms of the delay width, "1" is written to only data bits corresponding to widths to be specified and "0" is written to the remaining data bits.

TABLE 1

| | Delay Direction Setting | | Delay Width Setting | | | | |
|---|---|---|---|---|---|---|---|
| R00 | R01 | R02 | R03 | R04 | R05 | R06 | R07 |
| — | 1-417 | 17-41 | none | CL2/2 | CL2/4 | CL2/8 | CL2/16 |

As shown in Tables 2 and 3, eight bits R10 through R17 at the beginning of data transferred on data line LV1 and eight bits R20 through R27 at the beginning of data transferred on data line LV2 contain values for specifying the delay block division, i.e., for specifying a delay between which blocks. That is, "1" is written to only the data bit corresponding to a set of blocks between which a delay needs to occur. "0" is written to the remaining data bits.

TABLE 2

| Delay block division setting (1) | | | | | | | |
|---|---|---|---|---|---|---|---|
| R10 | R11 | R12 | R13 | R14 | R15 | R16 | R17 |
| 9-10 | 10-11 | 11-12 | 12-13 | 13-14 | 14-15 | 15-16 | 16-17 |

TABLE 3

| Delay block division setting (2) | | | | | | | |
|---|---|---|---|---|---|---|---|
| R20 | R21 | R22 | R23 | R24 | R25 | R26 | R27 |
| 1-2 | 2-3 | 3-4 | 4-5 | 5-6 | 6-7 | 7-8 | 8-9 |

As shown in Table 4-1, eight bits R30 through R37 at the beginning of data transferred on data line LV3 contain values to configure rising of an internal control (internal CL1) signal. An 8-bit counter value is used to specify clocks for the rising setting. The rise time is specified in accordance with a combination of values ("1" and "0") for the data bits R30 through R37. Specifically, as shown in Table 4-2, the rise time (the number of delay clocks) is set to any of 0 clocks (no delay) to 255 clocks in accordance with an 8-bit counter value dependent on values of the data bits R30 through R37.

TABLE 4-1

| Initial delay for rising setting of internal CL1 | | | | | | | |
|---|---|---|---|---|---|---|---|
| R30 | R31 | R32 | R33 | R34 | R35 | R36 | R37 |
| [0] | [1] | [2] | [3] | [4] | [5] | [6] | [7] |

TABLE 4-2

| 8-bit counter value | Delay clocks |
|---|---|
| 8h'00 | 0 (no delay) |
| 8h'01 | 1 |
| 8h'02 | 2 |
| . | . |
| . | . |
| . | . |
| 8h'ff | 255 |

As shown in Table 5-1, eight bits R40 through R47 at the beginning of data transferred on data line LV4 contain values to configure falling of the internal control (internal CL1) signal. An 8-bit counter value is also used to specify clocks for the falling setting. The fall time is specified in accordance with a combination of values ("1" and "0") for the data bits R40 through R47. Specifically, as shown in Table 5-2, the fall time (the number of delay clocks) is set to any of 0 clocks (no delay) to 255 clocks in accordance with an 8-bit counter value dependent on values of the data bits R30 through R37.

TABLE 5-1

| Initial delay for falling setting of internal CL1 | | | | | | | |
|---|---|---|---|---|---|---|---|
| R40 | R41 | R42 | R43 | R44 | R45 | R46 | R47 |
| [0] | [1] | [2] | [3] | [4] | [5] | [6] | [7] |

TABLE 5-2

| 8-bit counter value | Delay clocks |
|---|---|
| 8h'00 | 0 (no delay) |
| 8h'01 | 1 |
| 8h'02 | 2 |
| . | . |
| . | . |
| . | . |
| 8h'ff | 255 |

As shown Table 6-1, eight bits R50 through R57 at the beginning of data transferred on data line LV5 contain values to configure rising of an equalization signal. An 8-bit counter value is also used to specify clocks for the rising setting. The rise time is specified in accordance with a combination of values ("1" and "0") for the data bits R50 through R57. Specifically, as shown in Table 6-2, the rise time (the number of delay clocks) is set to any of 0 clocks (no delay) to 8 clocks in accordance with an 8-bit counter value dependent on values of the data bits R50 through R57.

TABLE 6-1

| Initial delay for rising setting of equalization | | | | | | | |
|---|---|---|---|---|---|---|---|
| R50 | R51 | R52 | R53 | R54 | R55 | R56 | R57 |
| [0] | [1] | [2] | [3] | [4] | [5] | [6] | [7] |

TABLE 6-2

| 8-bit counter value | Delay clocks |
|---|---|
| 8h'00 | 0 (no delay) |
| 8h'01 | 1 |
| 8h'02 | 2 |
| . | . |
| . | . |
| . | . |
| 8h'ff | 8 |

Figure 18:
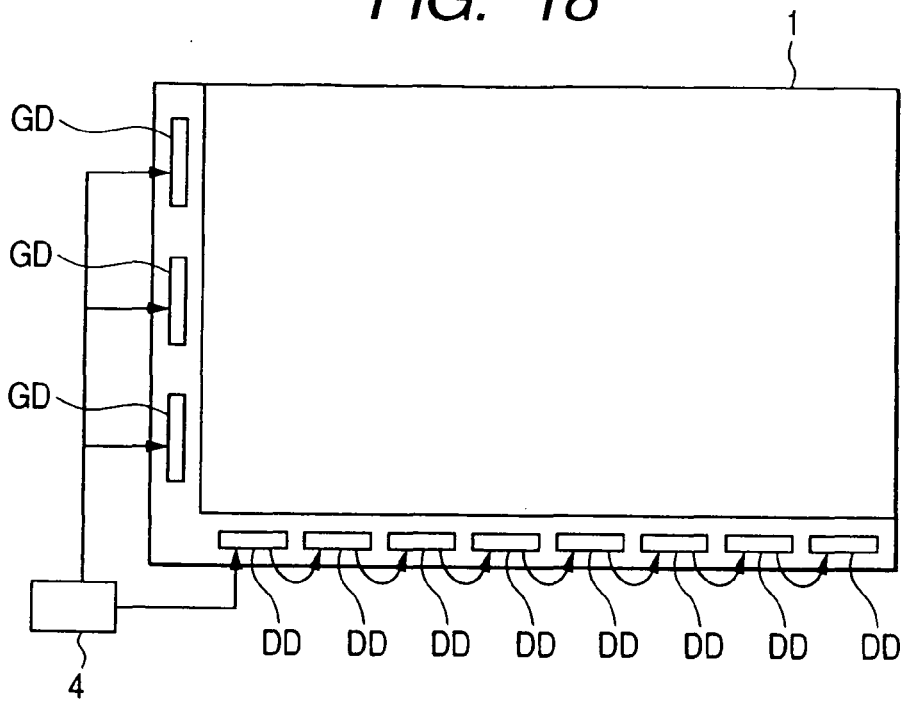
FIG. 18 is a schematic diagram exemplifying a method of transferring display data using scanning drivers arranged on one side only.
Figure 19:
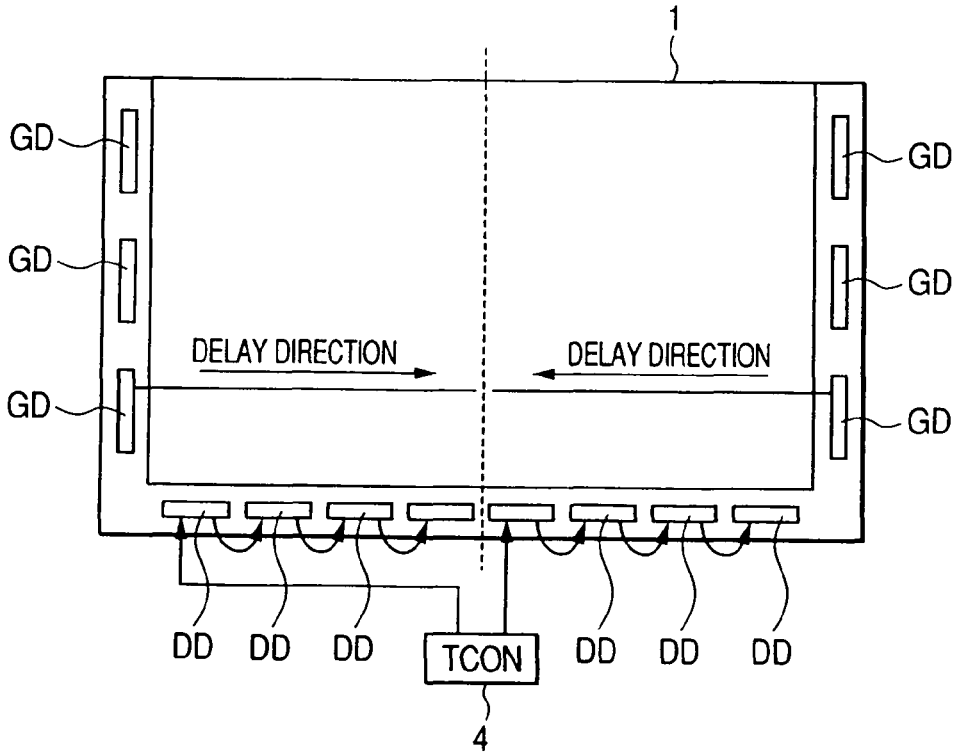
FIG. 19 is a schematic diagram exemplifying a method of transferring display data using scanning drivers arranged on two opposite sides.

FIGS. 18 and 19 are schematic diagrams exemplifying methods of transferring display data. FIG. 18 exemplifies a transfer method using scanning drivers arranged on one side only. FIG. 19 exemplifies a transfer method using scanning drivers arranged on two sides.

The display data signal output method according to embodiment 1 can not only delay the output timing of each block, but also control a delay direction.

As shown in FIG. 18, for example, the liquid crystal display panel 1 generally arranges scanning drivers (driver ICs DD) on one side of the display panel. The liquid crystal display panel unidirectionally transfers an operation signal input to each gate line. Such liquid crystal display panel sequentially inputs display data and register data from the timing controller 4 from the driver IC DD1 nearest to the scanning driver to the farthest driver IC DD8 as shown in FIG. 18. It is only necessary to generate an internal control signal so as to increase a delay width in accordance with a distance from the scanning driver.

The liquid crystal display panel 1 may be provided with the scanning driver's driver ICs GD on two opposite sides of the panel as shown in FIG. 19, for example. Such liquid crystal display panel uses two types of gate lines whose delay directions are reverse to each other as shown in FIG. 19. When the delay direction can be controlled as described in embodiment 1, the liquid crystal display panel shown in FIG. 19 can delay the output timing of display data from each block in accordance with the delay direction of the gate line passing through each block.

As mentioned above, the liquid crystal display apparatus according to embodiment 1 divides the drain line into multiple blocks and shifts (delays) a timing to output display data to each block to be able to equalize times to write data to TFT elements for pixels arranged in a direction along the extension of the gate line. It is possible to prevent irregular display and degraded display quality due to insufficiently written data.

Embodiment 2

Figure 20:
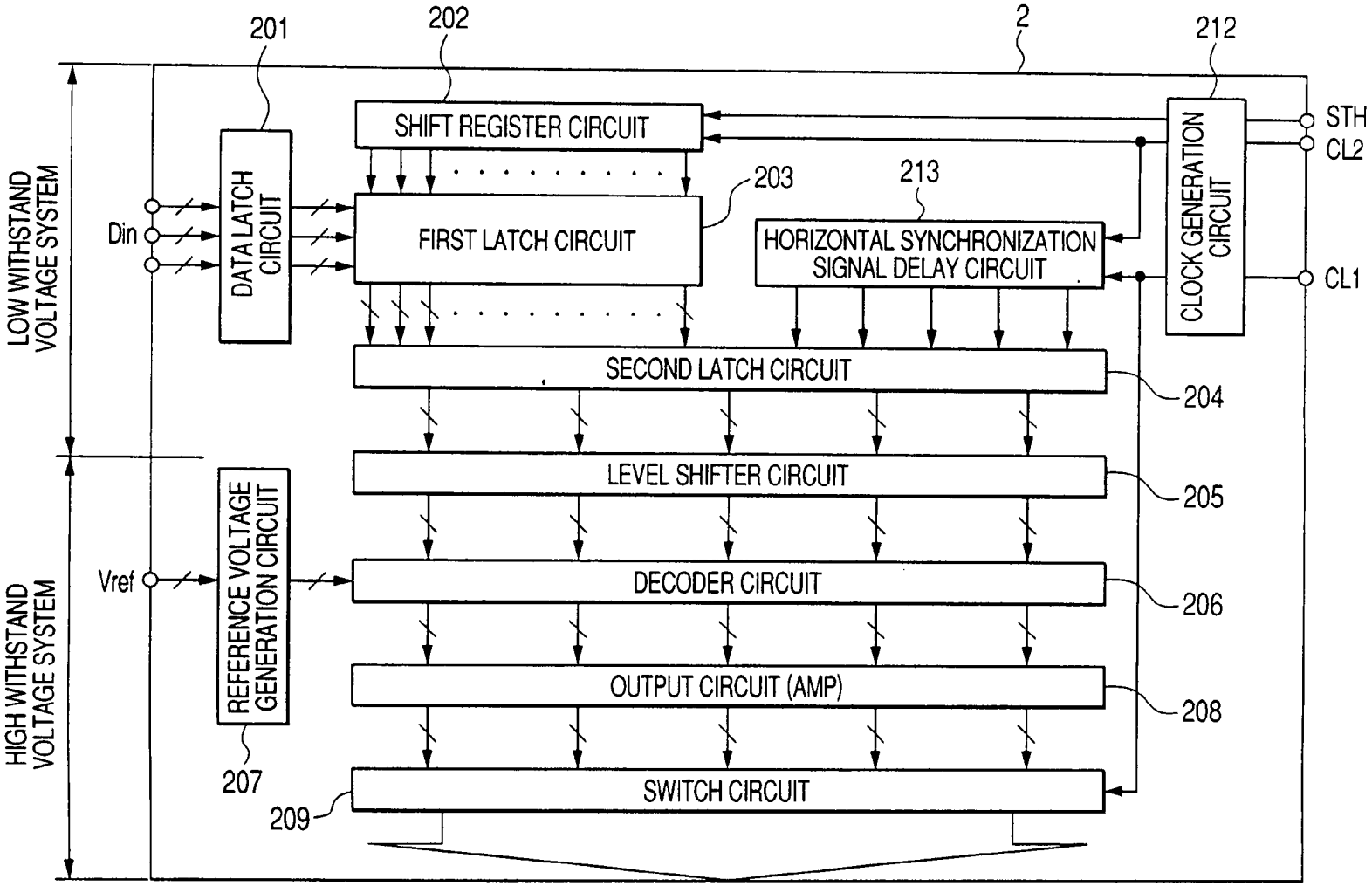
FIG. 20 is a schematic diagram showing the overview construction of a display apparatus according to embodiment 2 of the invention and a block diagram showing a construction example of a data driver.
Figure 21:
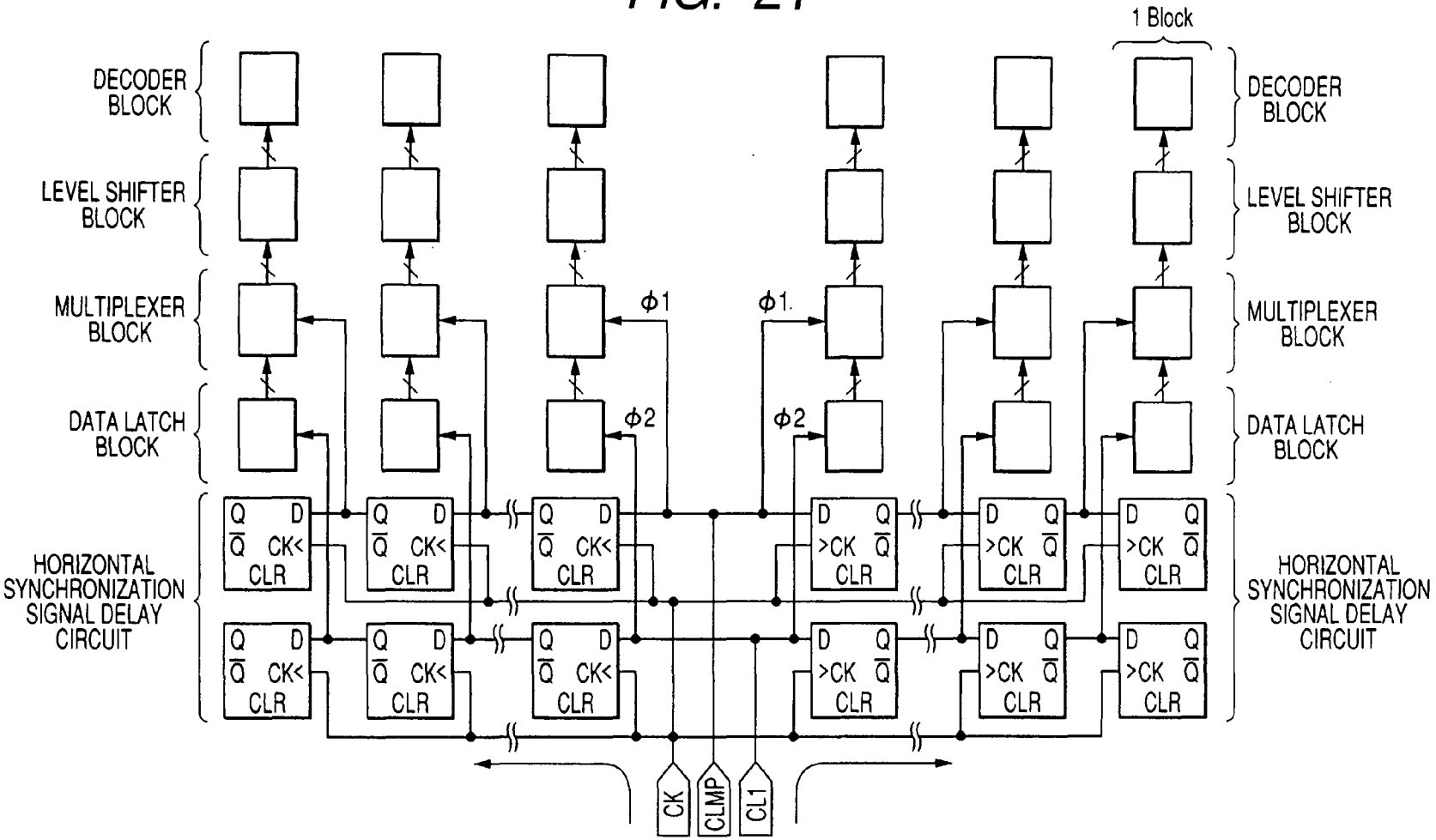
FIG. 21 is a schematic diagram showing the overview construction of the display apparatus according to embodiment 2 of the invention and a circuit block diagram showing a construction example ranging from a horizontal synchronization signal delay circuit to a decoder circuit.
Figure 22:
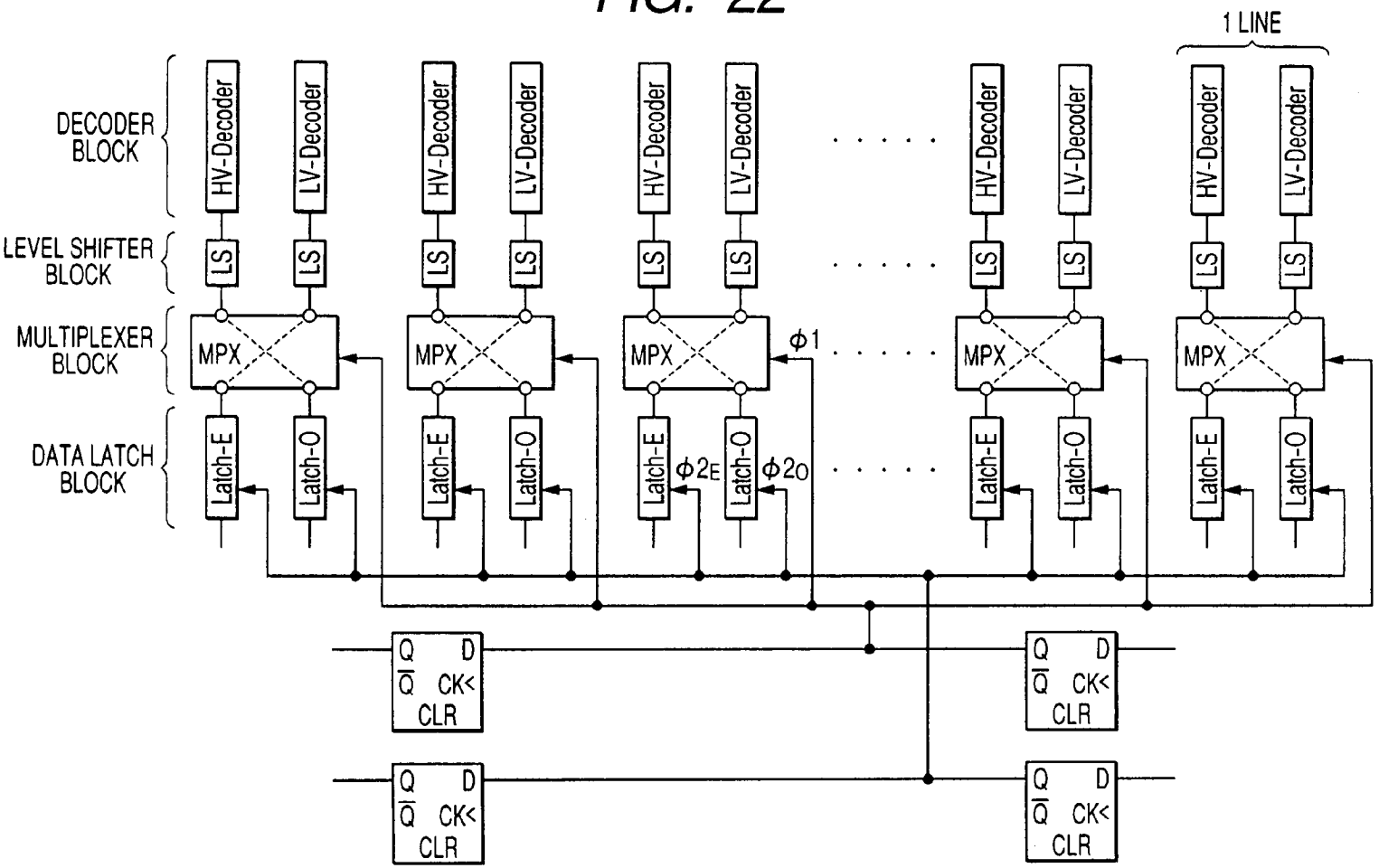
FIG. 22 is a schematic diagram showing the overview construction of the display apparatus according to embodiment 2 of the invention and a circuit block diagram showing a construction example ranging from the horizontal synchronization signal delay circuit to the decoder circuit.

FIGS. 20 through 22 are schematic diagrams showing the overview construction of a display apparatus according to embodiment 2 of the invention. FIG. 20 is a block diagram showing a construction example of the data driver. FIGS. 21 and 22 are circuit block diagrams showing a construction example ranging from a horizontal synchronization signal delay circuit to a decoder circuit.

The liquid crystal display apparatus according to embodiment 2 aims at decreasing a peak value of a momentary current occurring in the data driver 2 and preventing reliability of the data driver 2 and the display apparatus from degrading. In such liquid crystal display apparatus, the data driver 2 is constructed as shown in FIG. 20. In the construction of the data driver 2 in FIG. 20, a conventional data driver is also constructed to include the data latch circuit 201, the shift register 202, the first latch circuit 203, the second latch circuit 204, the level shifter circuit 205, the decoder circuit 206, the reference voltage generation circuit 207, the output circuit 208, the switch circuit 209, and a clock generation circuit 212. In addition to the constituent circuits, the display apparatus according to embodiment 2 also includes a horizontal synchronization signal delay circuit 213.

The horizontal synchronization signal delay circuit 213 is constructed to be a clock-synchronized delay circuit such as a flip-flop circuit as shown in FIGS. 21 and 22, for example. The second latch circuit 204 holds display data to be output to each drain line. The display data is divided into several blocks. A delay signal is generated to delay a horizontal synchronization signal in units of blocks and is input to the second latch circuit. The display data is divided into 10 to 20 blocks.

When the data driver 2 complies with the general dot inversion, it includes a multiplexer for selecting an HV decoder or an LV decoder as a timing to operate the level shifter circuit as shown in FIG. 22. The selecting timing also needs to be changed. For this reason, the horizontal synchronization signal delay circuit 213 according to embodiment 2 is provided with two systems of delay circuits. One generates delay signal □1 for delaying a pulse of the multiplexer. The other generates delay signal □2 for delaying a data latch pulse of the second latch circuit.

Each block of the second latch circuit 204 is supplied with delay signal □2 generated from the horizontal synchronization signal CL1 by the clock-synchronized delay circuit. The second latch circuit 204 incorporates display data equivalent to one horizontal synchronization period held in the first latch circuit 203 more than once in units of blocks in accordance with the type of delay signal □2. While a conventional technology incorporates display data at a time, incorporating display data more than once decreases the number of level shifter circuits to be driven at once. It is possible to avoid concentration of momentary currents occurring when the level shifter circuit is driven and the decoder circuit selects a gradation voltage. As a result, a momentary current's peak value can be reduced. A variation in the power supply voltage can be decreased. The data driver 2 and the display apparatus can be provided with improved reliability.

Figure 23:
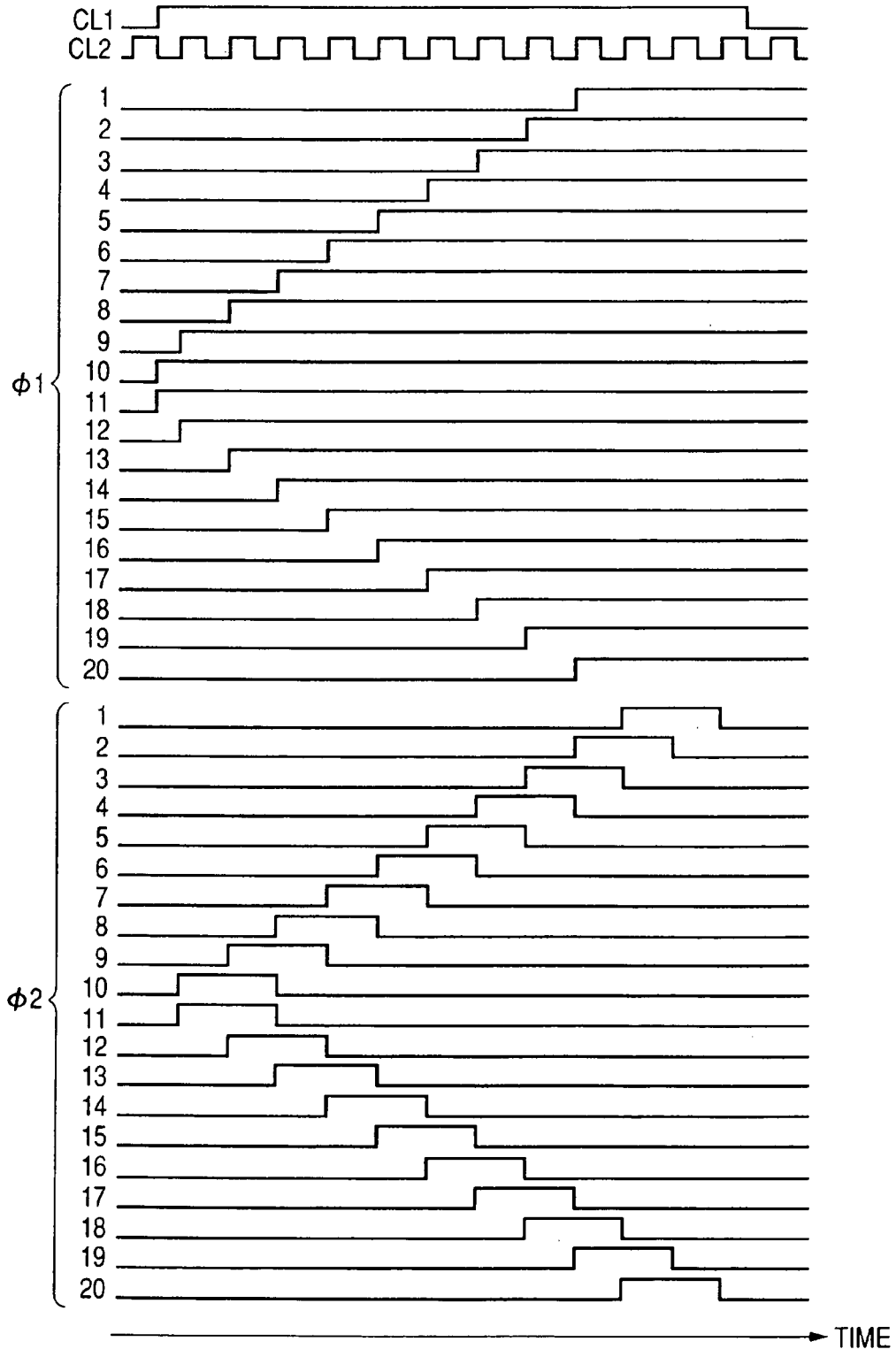
FIG. 23 is a schematic diagram illustrating a method of delaying incorporation of display data.

FIG. 23 is a schematic diagram illustrating a method of delaying incorporation of display data.

When the second latch circuit 204 delays incorporation of display data, it is preferable to start the output from the center one of divided blocks and delay the output toward both ends of blocks as shown in FIG. 23, for example. The example in FIG. 23 divides the second latch circuit 204 into 20 blocks and sequentially numbers the blocks 1, 2, 3, . . . , and 20 from a block at one end. The output starts from the tenth and eleventh blocks and finally ends with the first and 20th blocks at both ends. This makes it possible to decrease a possibility of causing irregularity among blocks for each driver IC when the data driver is composed of multiple driver ICs and each driver IC is constructed as shown in FIGS. 20 through 22, for example.

As mentioned above, the display apparatus according to embodiment 2 allows the second latch circuit 204 to incorporate display data equivalent to one horizontal synchronization period by dividing the display data into multiple blocks. It is possible to avoid concentration of momentary currents occurring when the level shifter circuit is driven. The data driver 2 and the display apparatus can be provided with improved reliability.

The embodiment can decrease a variation in the power supply voltage due to a momentary current, and therefore eliminate circuit components for suppressing variations such as a bypass capacitor. The construction according to embodiment 2 can be preferably applied to an onboard liquid crystal display apparatus for car navigation systems, for example.

While embodiment 2 has described the construction and operations of the data driver for avoiding concentration of the momentary current, it is obviously allowed to combine the construction with that described in embodiment 1, for example. It may be preferable not only to provide the horizontal synchronization signal delay circuit 213 for dispersing incorporation of display data by the second latch circuit 204 and avoiding concentration of the momentary current, but also to delay the timing of output from the data driver for each block. The invention is not limited thereto when the construction allows a phase between blocks to deviate at least half a cycle.

Embodiment 3

Figure 24:
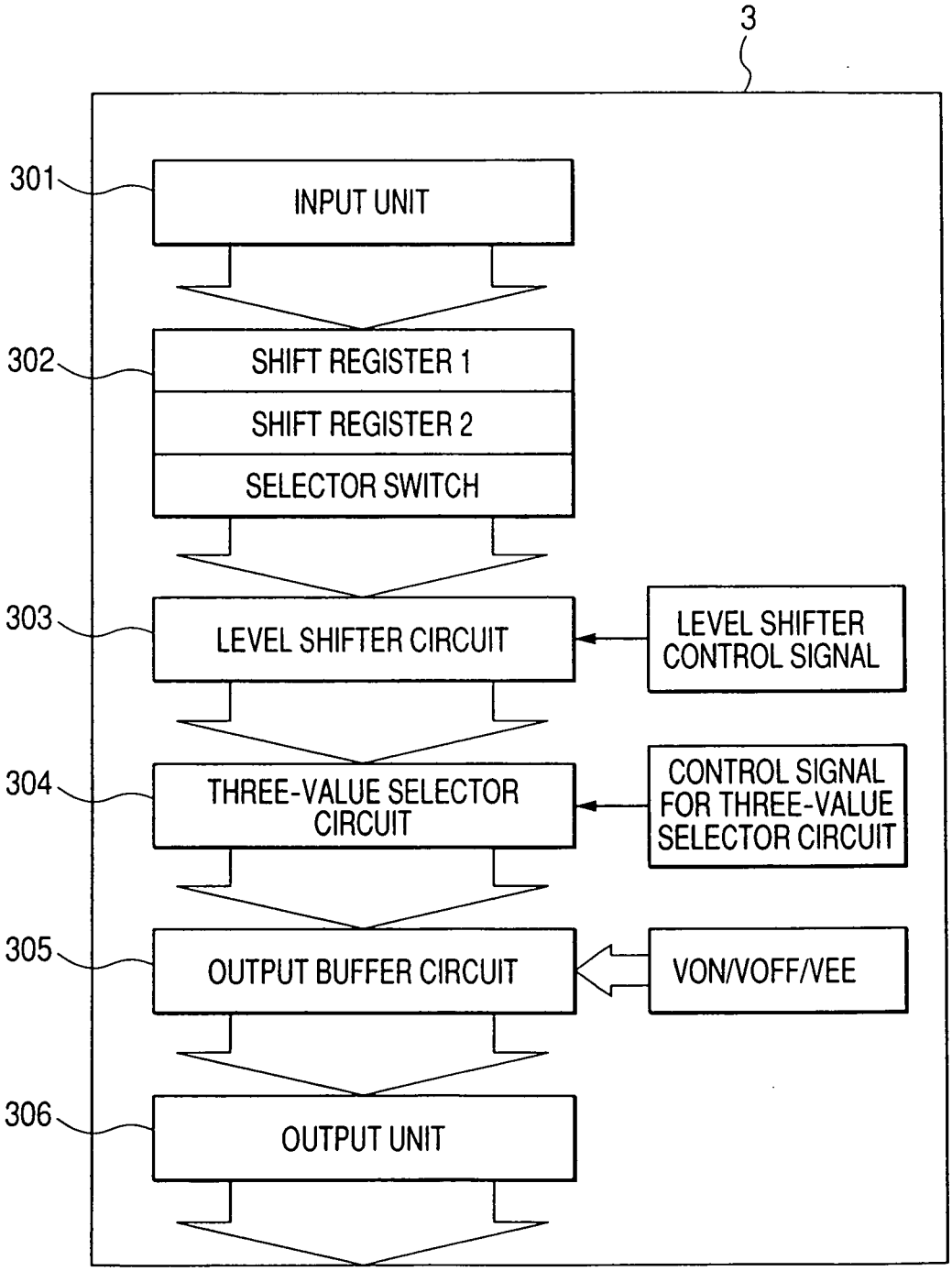
FIG. 24 is a schematic diagram showing the overview construction of the display apparatus according to embodiment 2 of the invention and a block diagram showing a construction example of the scanning driver.
Figure 25:
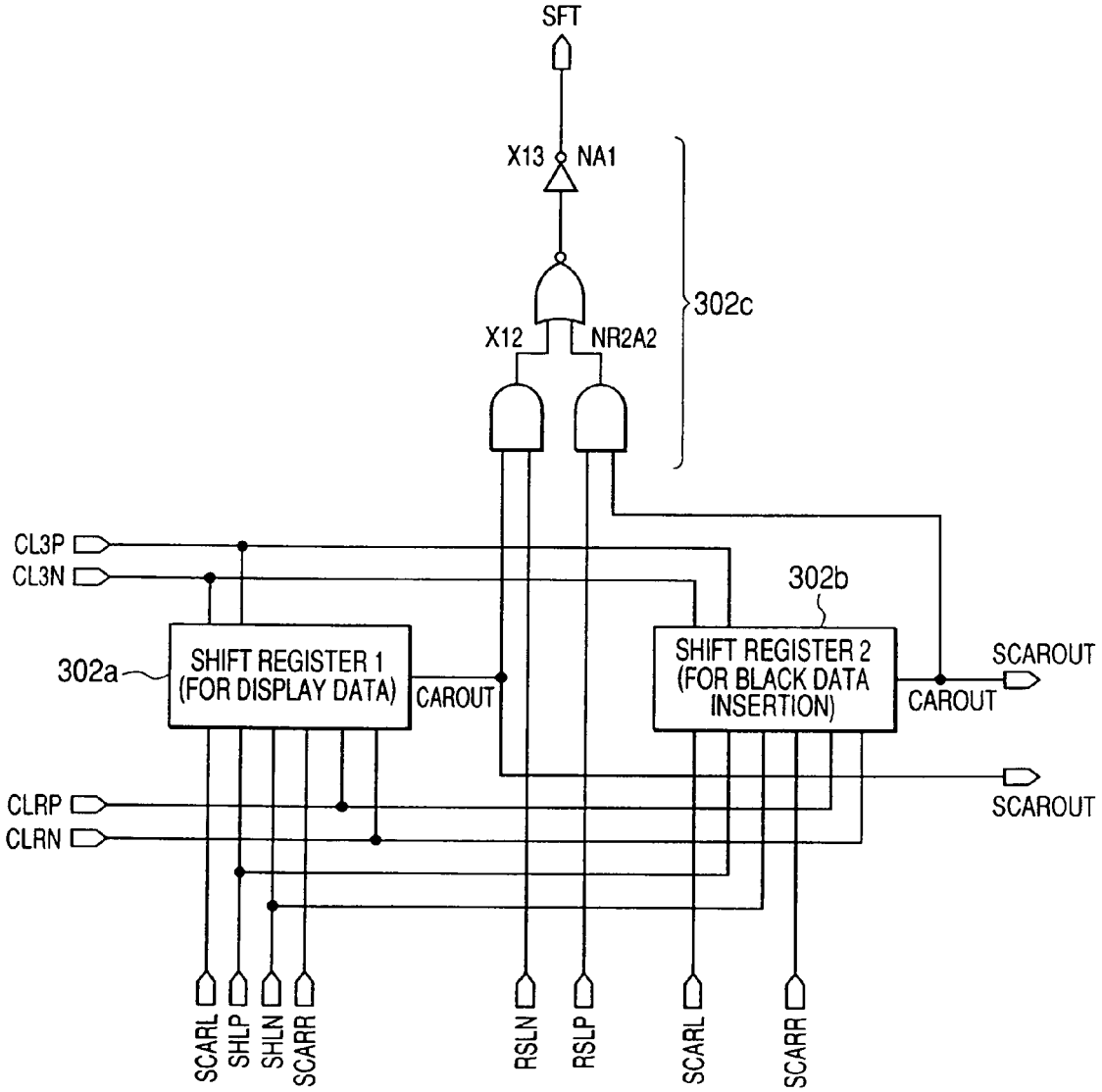
FIG. 25 is a schematic diagram showing the overview construction of the display apparatus according to embodiment 2 of the invention and a block diagram showing a construction example of a shift register circuit.

FIGS. 24 and 25 are schematic diagrams showing the overview construction of the display apparatus according to embodiment 3 of the invention. FIG. 24 is a block diagram showing a construction example of the scanning driver. FIG. 25 is a block diagram showing a construction example of a shift register circuit.

The liquid crystal display apparatus according to embodiment 3 inserts a black display at a constant interval when displaying an image (video). The liquid crystal display apparatus aims at cascade-connecting multiple scanning driver ICs and improving the flexibility of combining a gate line to output a scanning signal for display data with a gate line to output a scanning signal for black data insertion. In such liquid crystal display apparatus, the scanning driver 3 includes an input unit 301, a shift register unit 302, a level shifter circuit 303, a three-value selector circuit 304, an output buffer circuit 305, and an output unit 306 as shown in FIG. 24, for example. The input unit 301, the output buffer circuit 305, and the output unit 306 may conform to the construction of the scanning driver according to the prior art.

As shown in FIGS. 24 and 25, the shift register unit 302 includes a first shift register (shift register 1) 302*a*, a second shift register (shift register 2) 302*b*, and a selector switch 302*c* for supplying either of outputs from the shift registers 302*a* and 302*b* to the level shifter circuit 303. The first shift register 302*a* is assumed to be used for display data. The second shift register 302*b* is assumed to be used for black data insertion.

Figure 26:
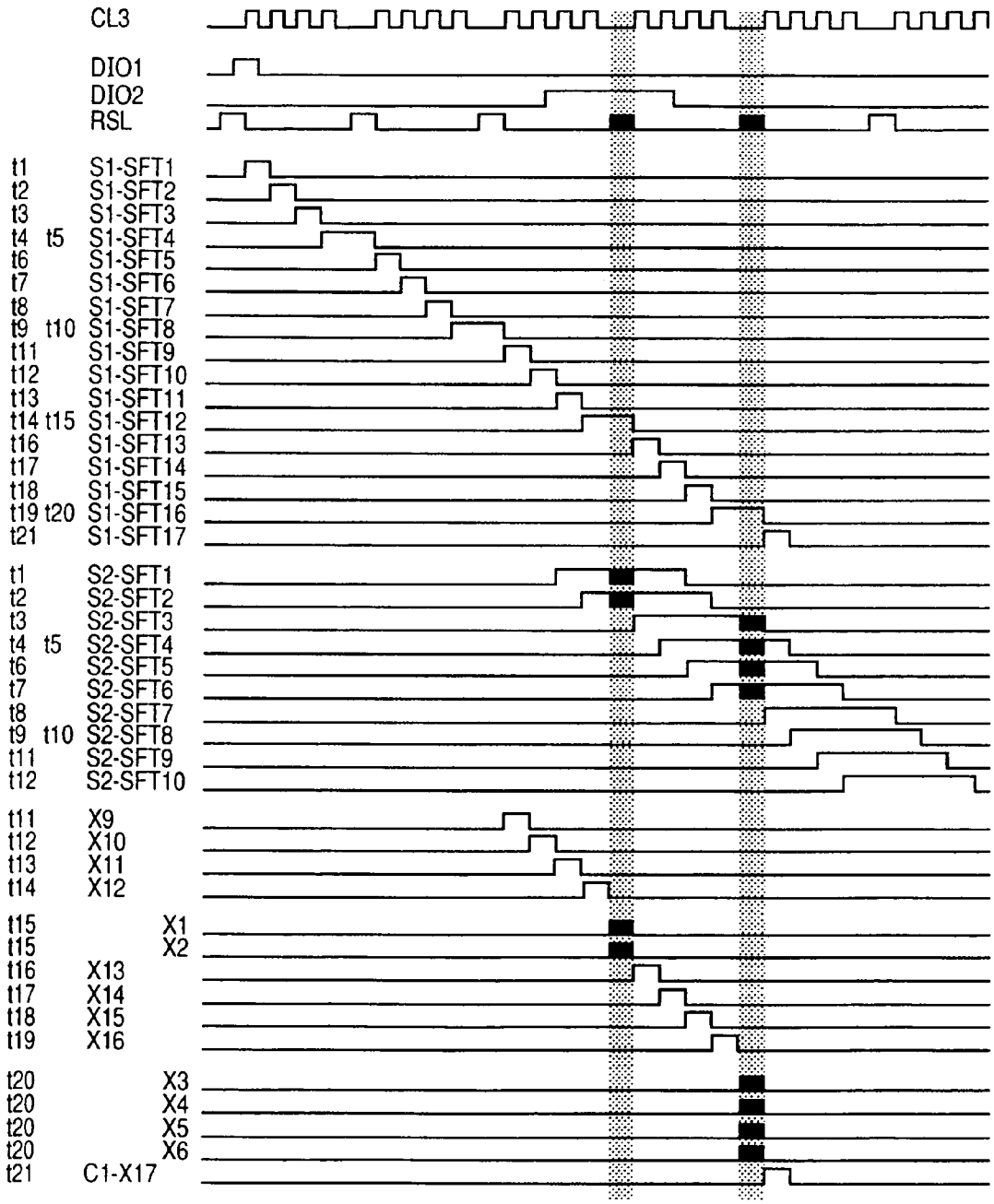
FIG. 26 is a schematic diagram showing timing waveforms of scanning signals in a display apparatus according to embodiment 3.

FIG. 26 is a schematic diagram showing timing waveforms of scanning signals in a display apparatus according to embodiment 3.

The scanning driver 3 for the display apparatus according to embodiment 3 includes the first shift register 302*a* for display data and the second shift register 302*b* for black data insertion. Independent DIO signals are supplied to the shift registers 302*a* and 302*b*. A first DIO signal DIO1 is supplied to the first shift register 302*a*. A second DIO signal DIO2 is supplied to the second shift register 302*b*. The second DIO signal DIO2 is controlled based on an input signal timing. FIG. 26 shows the relationship among timing waveforms for the DIO signals DIO1 and DIO2, and a selection signal RSL supplied to the selector switch 302*c*, for example.

In the display apparatus according to embodiment 3, the first shift register 302*a* outputs scanning signals for display data S1-SFT1 through S1-SFT17 between start time t1 and time t21 as shown in FIG. 26, for example.

The second shift register 302*b* outputs scanning signals for black data insertion S2-SFT1 through S2-SFT10 between start time t1 and time t21 as shown in FIG. 26, for example.

Gate lines GL are sequentially numbered from X1 through XM from the end. FIG. 26 shows the relationship between gate lines when a scanning signal is output between times t11 and t21. For example, scanning signal S1-SFT12 for display data is output at the timing to output scanning signals S2-SFT1 and S2-SFT2 for black data insertion. When such situation occurs in the same chip using one shift register as conventionally practiced, black data is written to a pixel where the display data signal needs to remain, i.e., the pixel connected to the gate line GL (X12). Since embodiment 3 uses two shift register, no black data is written.

The example in FIG. 26 selects a shift register output for S1 at timing t14 or t19 to output a scanning signal for display data. That is, display data is written to the pixel connected to the gate line GL (X12 or X16). Using two shift registers, embodiment 3 selects a shift register output for S2 not S1 at timing t15 or t20 within the same cycle for t14 or t19 to output a scanning signal for black data insertion. That is, black display data is written to the pixel connected to the gate line GL (X1 through X2 or X3 through X6). There is no influence on the pixel connected to the gate line GL (X12 or X16) where the scanning signal for display data is output at t14 or t19. The embodiment can prevent black data from being written to a pixel where the display data signal needs to remain, i.e., the pixel connected to the gate line GL (X12). The same chip can output a scanning signal for display data and a scanning signal for black data insertion. Further, multiple chips (driver ICs) can be cascade-connected.

Figure 27:
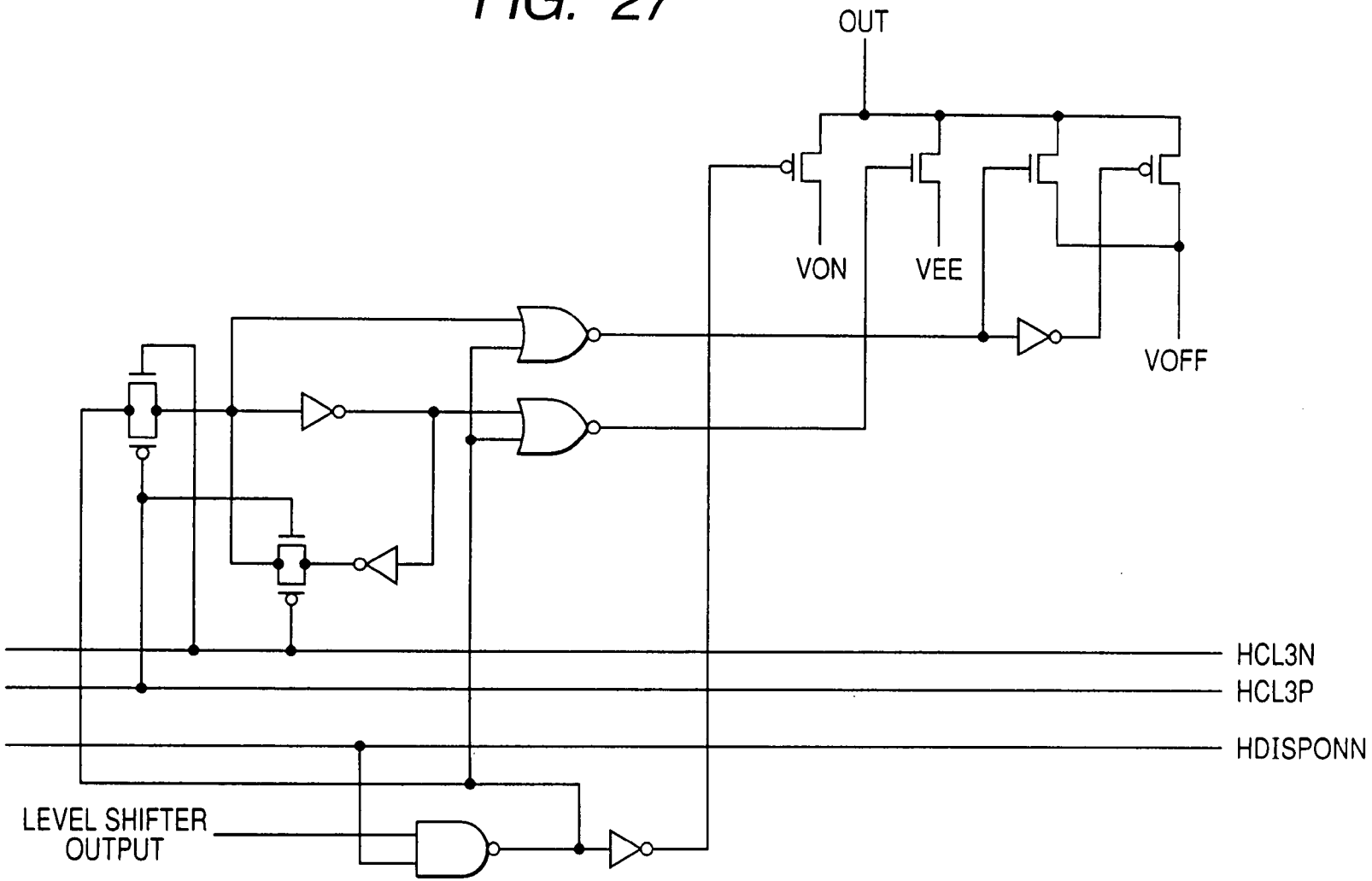
FIG. 27 is a circuit diagram showing a construction example of a three-value selector in the scanning driver according to embodiment 3.
Figure 28:
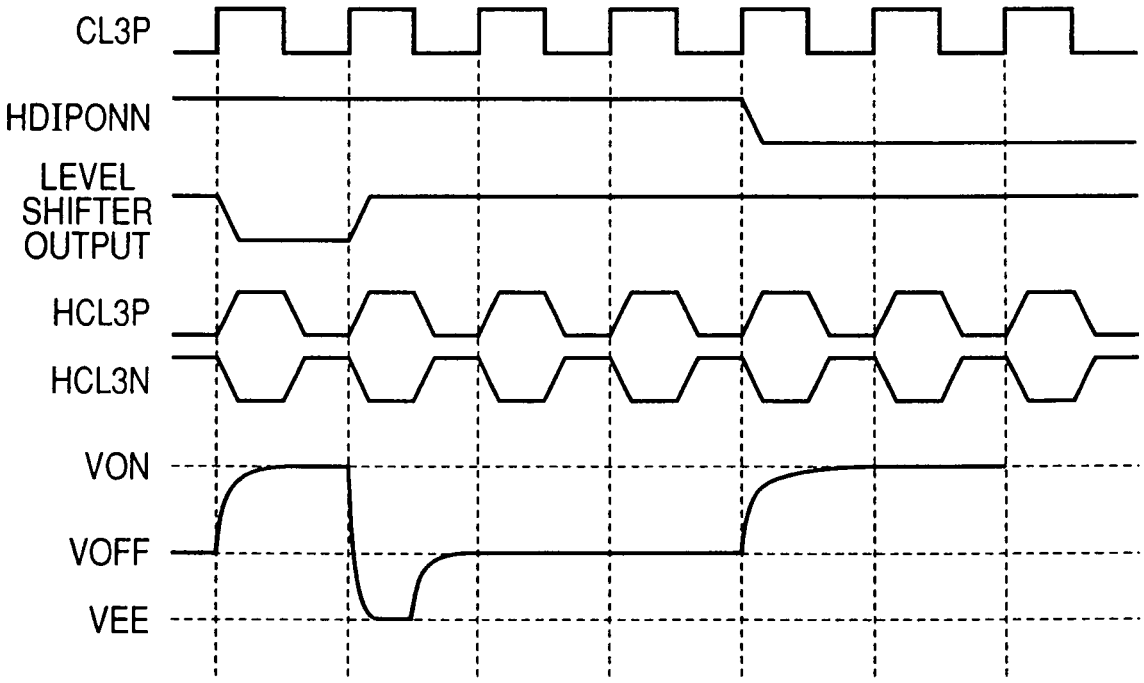
FIG. 28 is a waveform diagram illustrating operations of the three-value selector.
Figure 29:
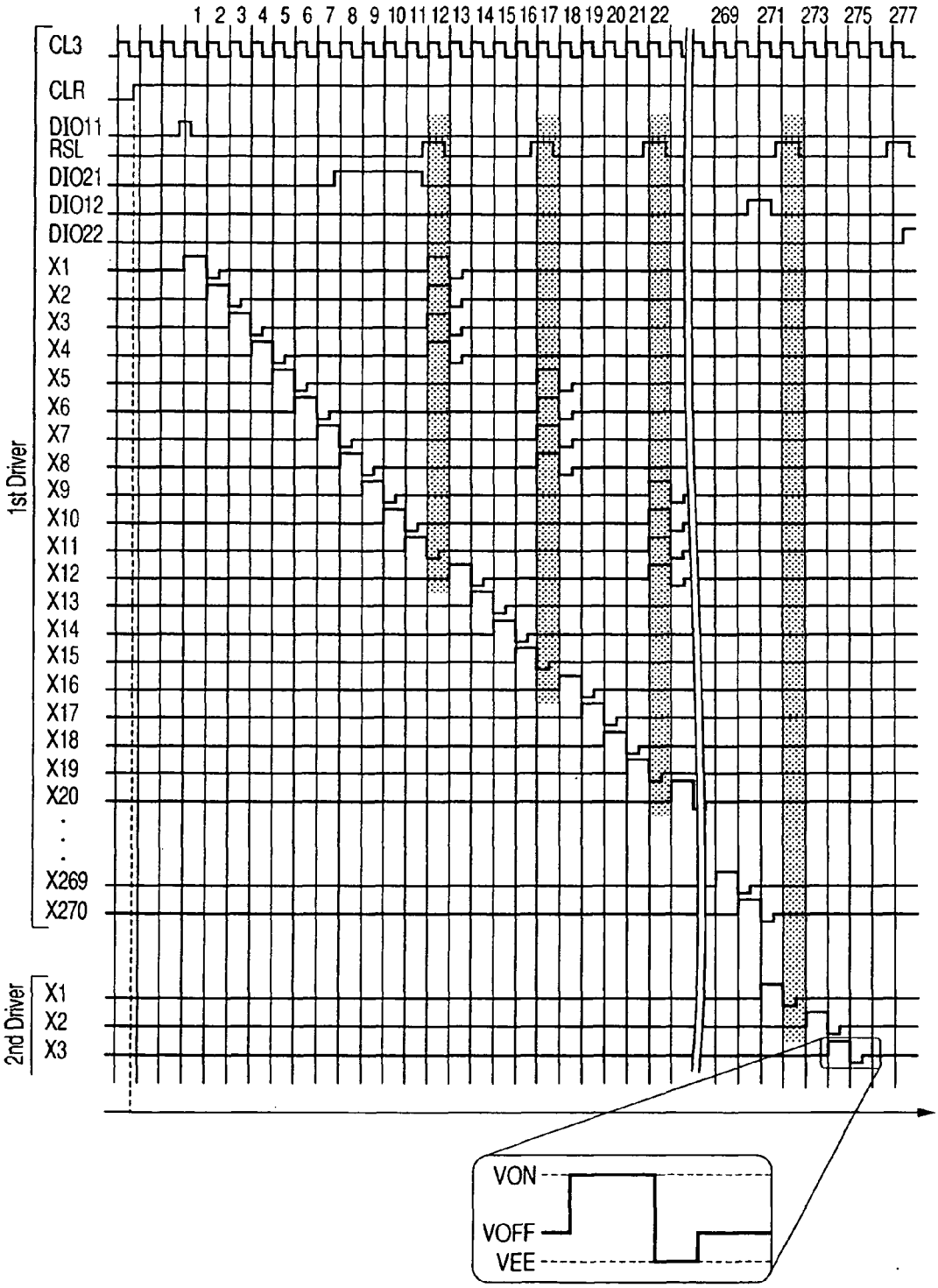
FIG. 29 shows scanning signal output waveforms according to three-value output.

FIG. 27 is a circuit diagram showing a construction example of a three-value selector in the scanning driver according to embodiment 3. FIG. 28 is a waveform diagram illustrating operations of the three-value selector. FIG. 29 shows scanning signal output waveforms according to three-value output.

The scanning driver according to embodiment 3 uses the level shifter circuit 303 and the three-value selector circuit 304 to output a scanning signal in three values. The three-value selector circuit 304 is constructed as shown in FIG. 27. This construction can provide not only two levels of display level VON and non-display level VOFF, but also a third level of VEE lower than the non-display level as shown in FIG. 28, for example.

FIG. 28 shows waveforms of operation signal actually output the gate lines (X1, X2, . . . ) according to this construction.

Figure 30:
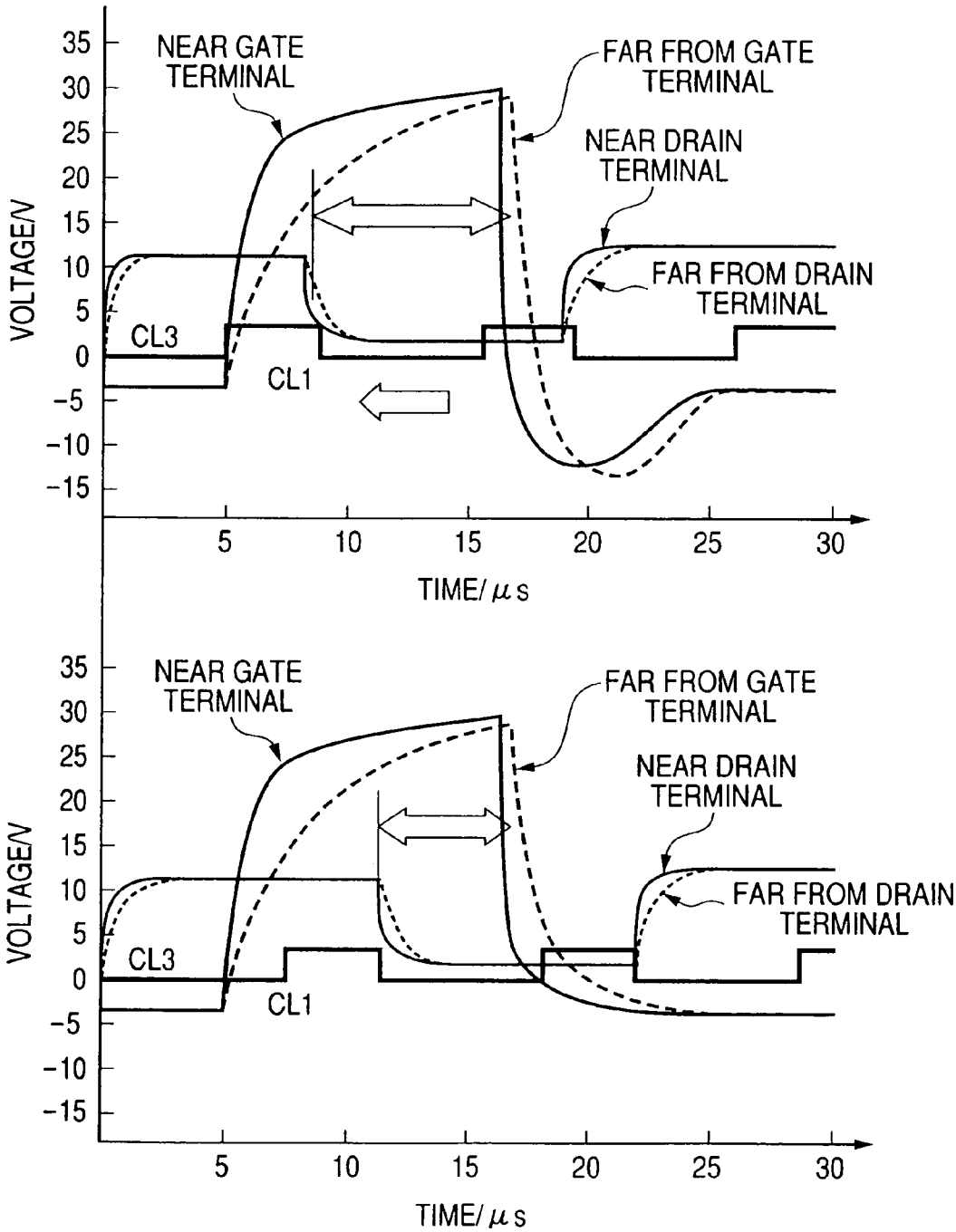
FIG. 30 illustrates an effect of three-value output.

FIG. 30 illustrates an effect of three-value output. In FIG. 30, the upper part shows waveforms for three-value output. The lower part shows waveforms for conventional two-value output for comparison.

Embodiment 3 provides display level VON, non-display level VOFF, and the third level VEE lower than non-display level VOFF. In this case, the waveform of a scanning signal input to the gate line falls from display level VON, and then once goes to the third level VEE lower than non-display level VOFF on the way back to non-display level VOFF. The waveform falls from display level VON more sharply than the conventional two-value output, thus shortening the fall time. This makes it possible to lengthen the time to incorporate data.

A conventional scanning driver conforms to the circuit construction that includes only two values of display level VON and non-display level VOFF. Providing such circuit construction with three-value output signifies enlargement of the circuit scale. When the three values are output by independently controlling a scanning signal for display data and a scanning signal for black data insertion, it is necessary not only to combine simple logic circuits, but also to latch data. A high withstand voltage system (system operating on high voltage) needs to be used to construct the circuit subsequent to the level shifter. Not only the circuit scale, but also the circuit construction becomes complicated. The driver IC chip size of increases.

On the other hand, embodiment 3 provides two shift register circuits 302*a* and 302*b* and selects one of outputs from these to output the three values. This makes it possible to prevent the circuit scale and the driver IC chip size from increasing.

As mentioned above, the liquid crystal display apparatus according to embodiment 3 uses the shift register circuit 302 that is composed of the first shift register circuit 302*a* for display data, the second shift register circuit 302*b* for black data insertion, and the selector switch 302*c* for selecting one of outputs from these shift registers and supplying the selected output to the level shifter 303. The same chip can output a scanning signal for display data and a scanning signal for black data insertion. Further, multiple chips (driver ICs) can be cascade-connected.

The level shifter circuit 303 and three-value selector circuit 304 output a scanning signal in three values. This makes it possible to lengthen the time to incorporate data for a TFT element corresponding to each pixel and improve the display quality.

The scanning driver according to embodiment 3 can also supply each chip (driver IC) with a signal for controlling the timing and the number of outputs and uses a counter circuit and a latch circuit in the chip to generate and control data for black data insertion.

A differential level shifter circuit may be used as the level shifter circuit 303. This makes it possible to construct and provide a small-scale control signal circuit for the latch circuit constructed to be a high withstand voltage system.

Figure 31:
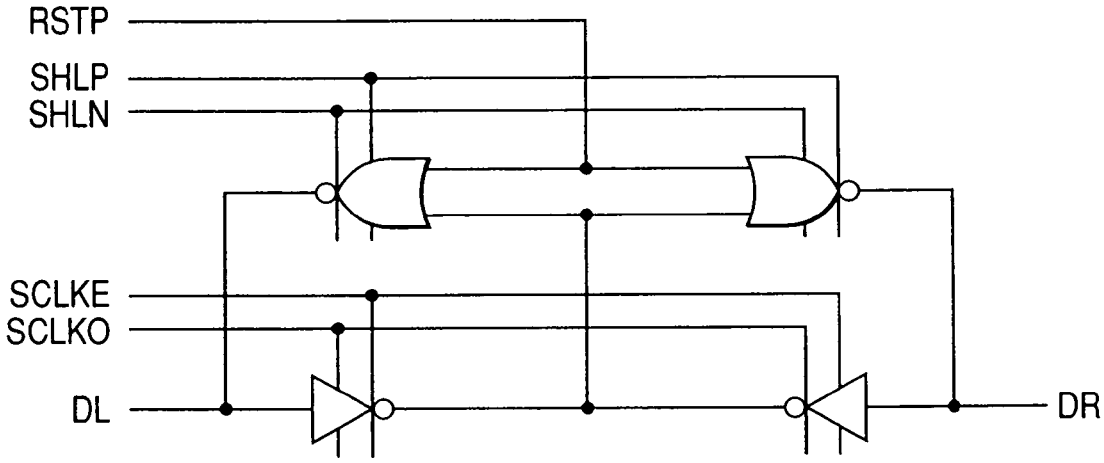
FIG. 31 shows a construction example of the shift register circuit and provides a schematic circuit diagram.
Figure 32:
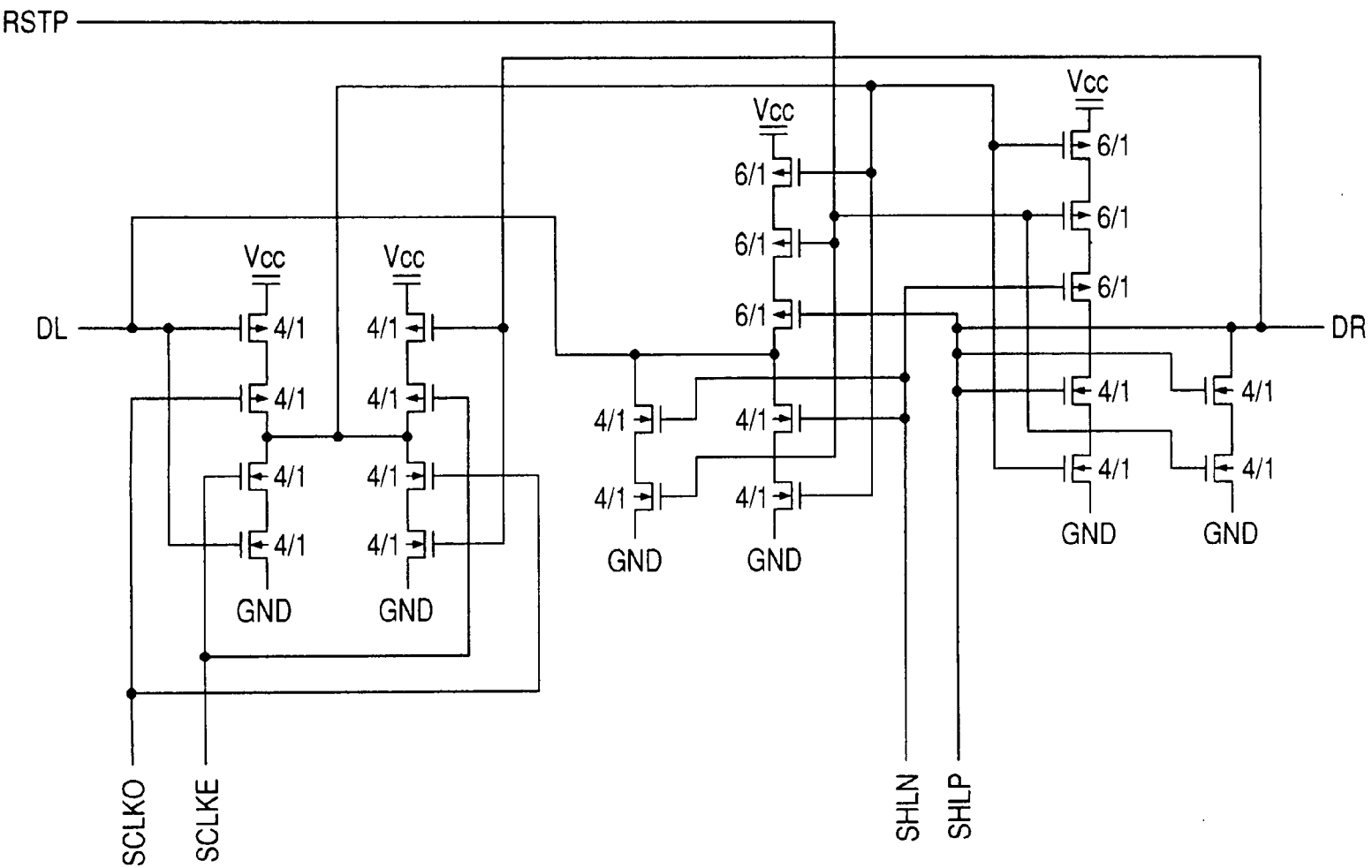
FIG. 32 shows a construction example of the shift register circuit and provides a circuit diagram specifically representing the circuit in FIG. 31.

FIGS. 31 and 32 shows a construction example of the shift register circuit. FIG. 31 provides a schematic circuit diagram. FIG. 32 provides a circuit diagram specifically representing the circuit in FIG. 31.

The shift register circuits 302*a* and 302*b* in the scanning driver according to embodiment 3 are generally constructed as shown in FIGS. 31 and 32, for example. However, the invention is not limited to this construction and may use the other circuit constructions as long as there is provided a function to transfer data.

Embodiment 4

Figure 33:
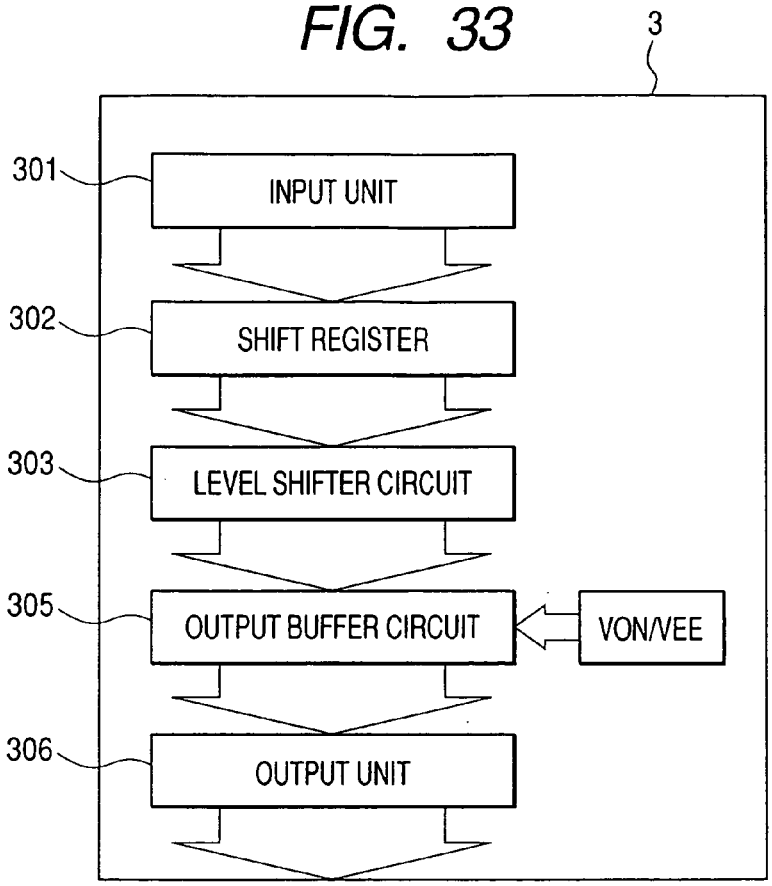
FIG. 33 is a schematic diagram showing the overview construction of a display apparatus according to embodiment 4 of the invention and a block diagram showing a construction example of a data driver.
Figure 34:
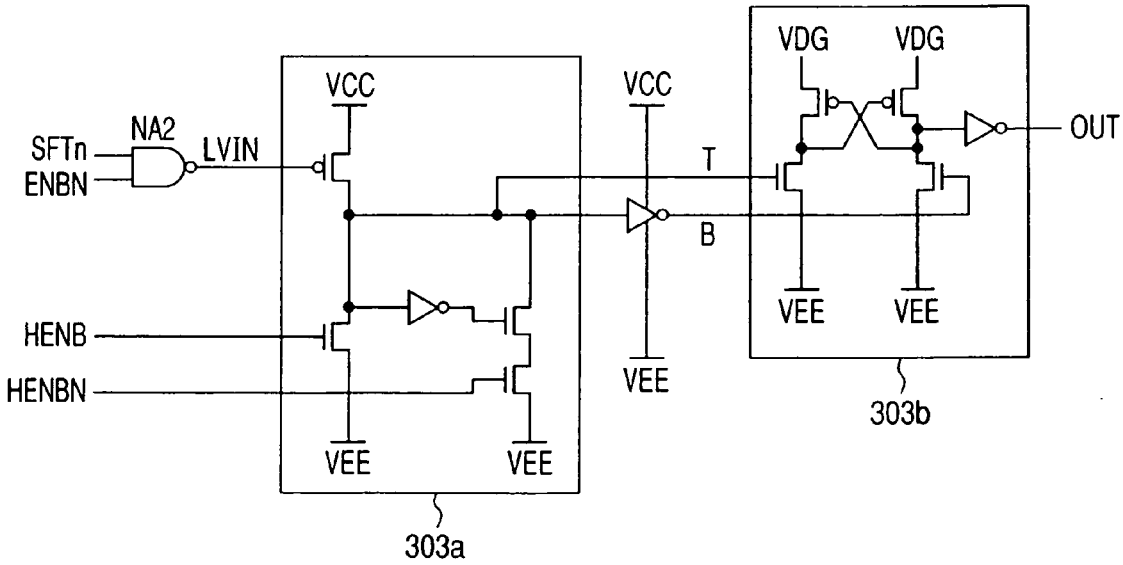
FIG. 34 is a schematic diagram showing the overview construction of the display apparatus according to embodiment 4 of the invention and a circuit diagram showing a construction example of a level shifter circuit.

FIGS. 33 and 34 are schematic diagrams showing the overview construction of a display apparatus according to embodiment 4 of the invention. FIG. 33 is a block diagram showing a construction example of a data driver. FIG. 34 is a circuit diagram showing a construction example of a level shifter circuit.

The liquid crystal display apparatus according to embodiment 4 aims at using a conventionally sized MOS transistor to operate a level shifter circuit. In such liquid crystal display apparatus, the scanning driver is constructed as shown in FIG. 33, for example. The construction in FIG. 33 shows a circuit block needed for the number of outputs and the construction of signals for controlling the block. The construction includes an input unit 301, a shift register 302, a level shifter circuit 303, an output buffer circuit 305, and an output unit 306. In the scanning driver according to embodiment 4, the shift register 302 may conform to a conventional, general construction, not the one as described in embodiment 3.

The level shifter circuit 303 need not perform three-value output as described in embodiment 3 and may conform to the conventional circuit construction for two-value output. As shown in FIG. 34, however, embodiment 4 requires the level shifter circuit 303 to include a latch circuit 303*a* at the first stage and a conventional cross-coupled circuit 303*b* at the second stage.

In the level shifter circuit 303 according to this construction, the latch circuit 303*a* at the first stage holds signal LVIN equivalent to one clock cycle supplied from an NAND gate. Before the next signal is input, the latch circuit 303*a* uses three types of enable signals ENBN, HENB, and HENBN to control input signal LVIN and reset a signal holding portion.

Figure 35:
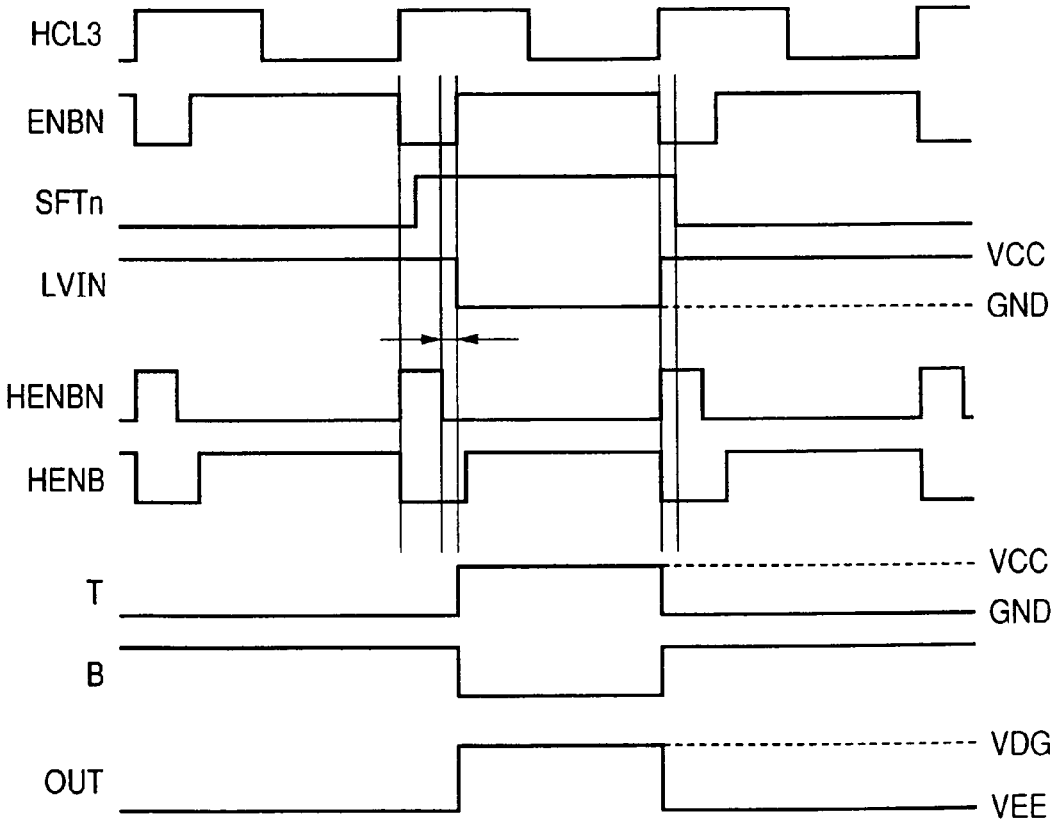
FIG. 35 is a schematic diagram illustrating operations of the level shifter circuit according to embodiment 4.

FIG. 35 is a schematic diagram illustrating operations of the level shifter circuit according to embodiment 4.

The level shifter circuit 303 according to embodiment 4 uses the first enable signal HENB and the second enable signal HENBN to reset a signal holding node as shown in FIG. 35. The level shifter circuit 303 uses the third enable signal ENBN to incorporate input signal LVIN. The level shifter circuit 303 holds the incorporated signal equivalent to one clock cycle. Before a signal for the next cycle is input, the level shifter circuit 303 uses the first enable signal HENB and the second enable signal HENBN to reset the signal holding node.

In accordance with this operation, FIG. 35 shows the states of two signals T and B to be transferred to the circuit 303*b* at the second stage from the circuit 303*a* at the first stage. FIG. 35 also shows the state of output signal OUT to be output via the circuit 303*b* at the second stage.

Figure 36:
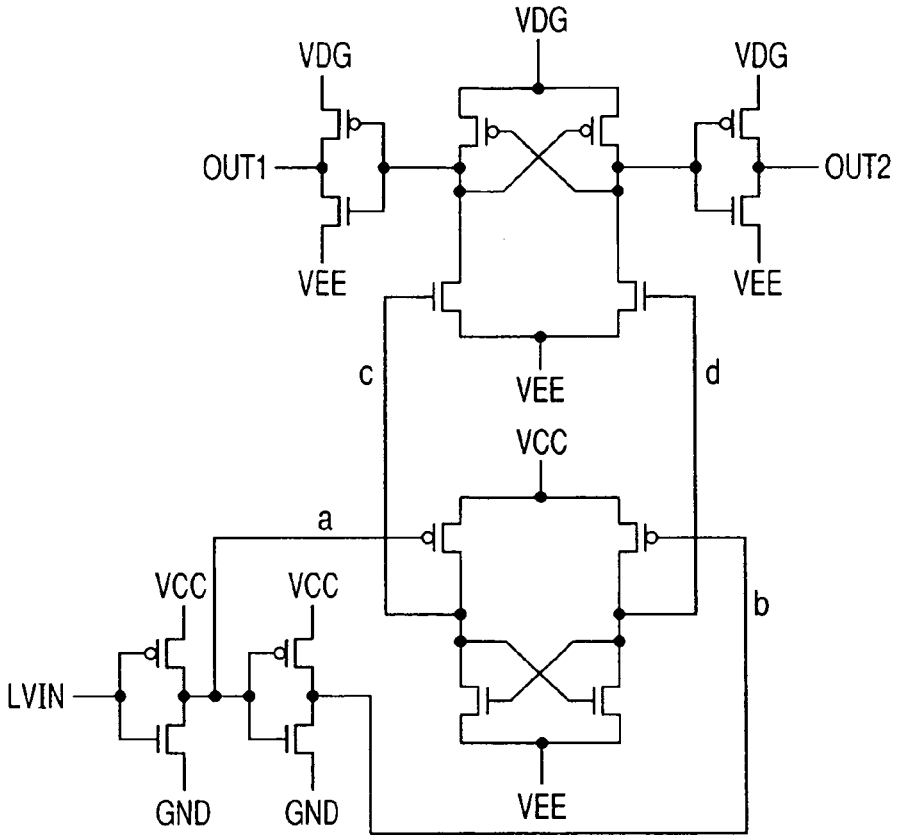
FIG. 36 shows a construction example of a conventional level shifter circuit in comparison with the level shifter circuit according to embodiment 4.
Figure 37:
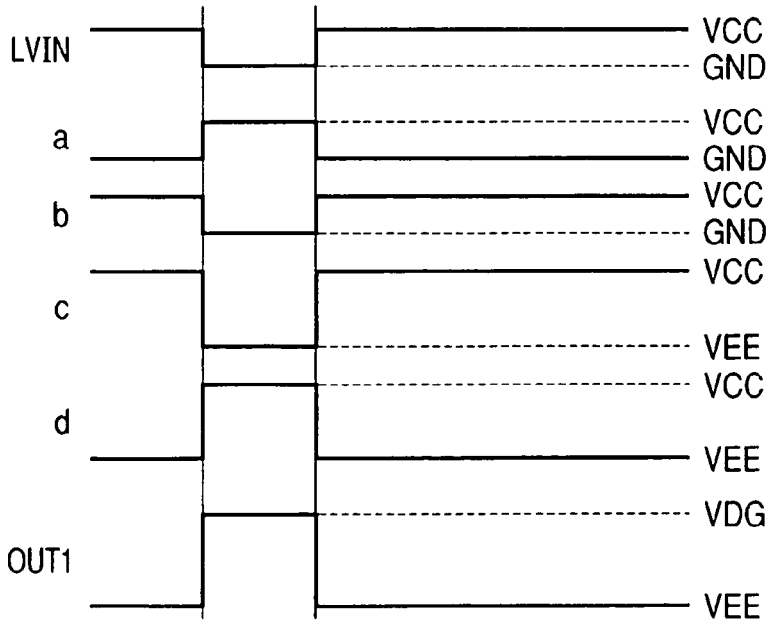
FIG. 37 shows operations of the level shifter circuit in FIG. 36.

FIG. 36 shows a construction example of a conventional level shifter circuit in comparison with the level shifter circuit according to embodiment 4. FIG. 37 shows operations of the level shifter circuit in FIG. 36.

A conventional level shifter circuit is normally constructed to include two circuits 303*b* at the second stage. As shown in FIG. 36, for example, output signals a and b from two inverter circuits are input to gates of two P-channel MOS transistors of a first-stage cross-coupled circuit. Output signal c and d from drains of two N-channel MOS transistors are input to gates of two N-channel MOS transistors of a second-stage cross-coupled circuit. Outputs from drains of two P-channel MOS transistors are input to inverter circuits. Finally, two output signals OUT1 and OUT2 are generated. For example, FIG. 37 shows states of signal LVIN input to the level shifter circuit, output signals a and b from the inverter circuits, output signals c and d from the first-stage cross-coupled circuit, and the two final output signals OUT1 and OUT2. The relationship between the input signal LVIN and the final output signal OUT in FIG. 37 matches the relationship between the input signal LVIN and the output signal OUT in FIG. 35. It can be understood that the level shifter circuit in FIG. 34 has the function equivalent to that of the level shifter circuit in FIG. 36.

When the level shifter circuit in FIG. 34 is compared with the level shifter circuit in FIG. 36, the same number of MOS transistor circuits is used. Since the circuit construction in FIG. 34 consumes a smaller amount of electric current, the size per transistor can be reduced. When the first-stage circuit is changed to the latch circuit from the conventional cross-coupled circuit, the entire size of the level shifter circuit can be reduced.

However, the latch circuit 303*a* needs to input high-withstand-voltage signals as the first enable signal HENB and the second enable signal HENBN. A cross-coupled circuit may be used to generate the first enable signal HENB and the second enable signal HENBN. However, using a differential circuit can further reduce the chip size.

Figure 38:
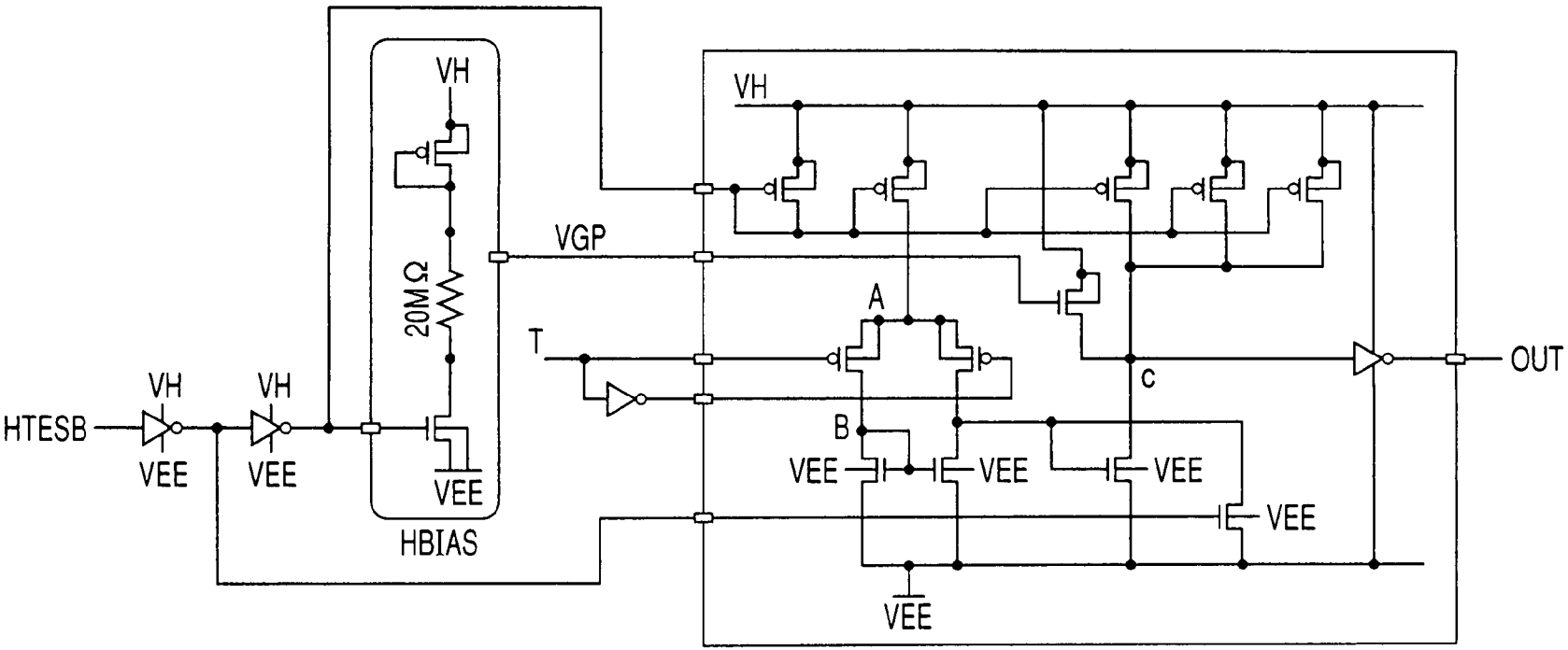
FIG. 38 is a circuit diagram showing a construction example of a differential circuit for generating a high-withstand-voltage enable signal.

FIG. 38 is a circuit diagram showing a construction example of a differential circuit for generating a high-withstand-voltage enable signal.

A differential amplifier circuit as shown in FIG. 38 is used to generate first enable signal HENB and the second enable signal HENBN. Embodiment 4 uses the differential amplifier circuit as a voltage conversion circuit, not as an amplifier for amplifying a small signal. This makes it possible to generate and supply the high-withstand-voltage enable signals HENB and HENBN needed for the latch circuit 303*a*.

Figure 39:
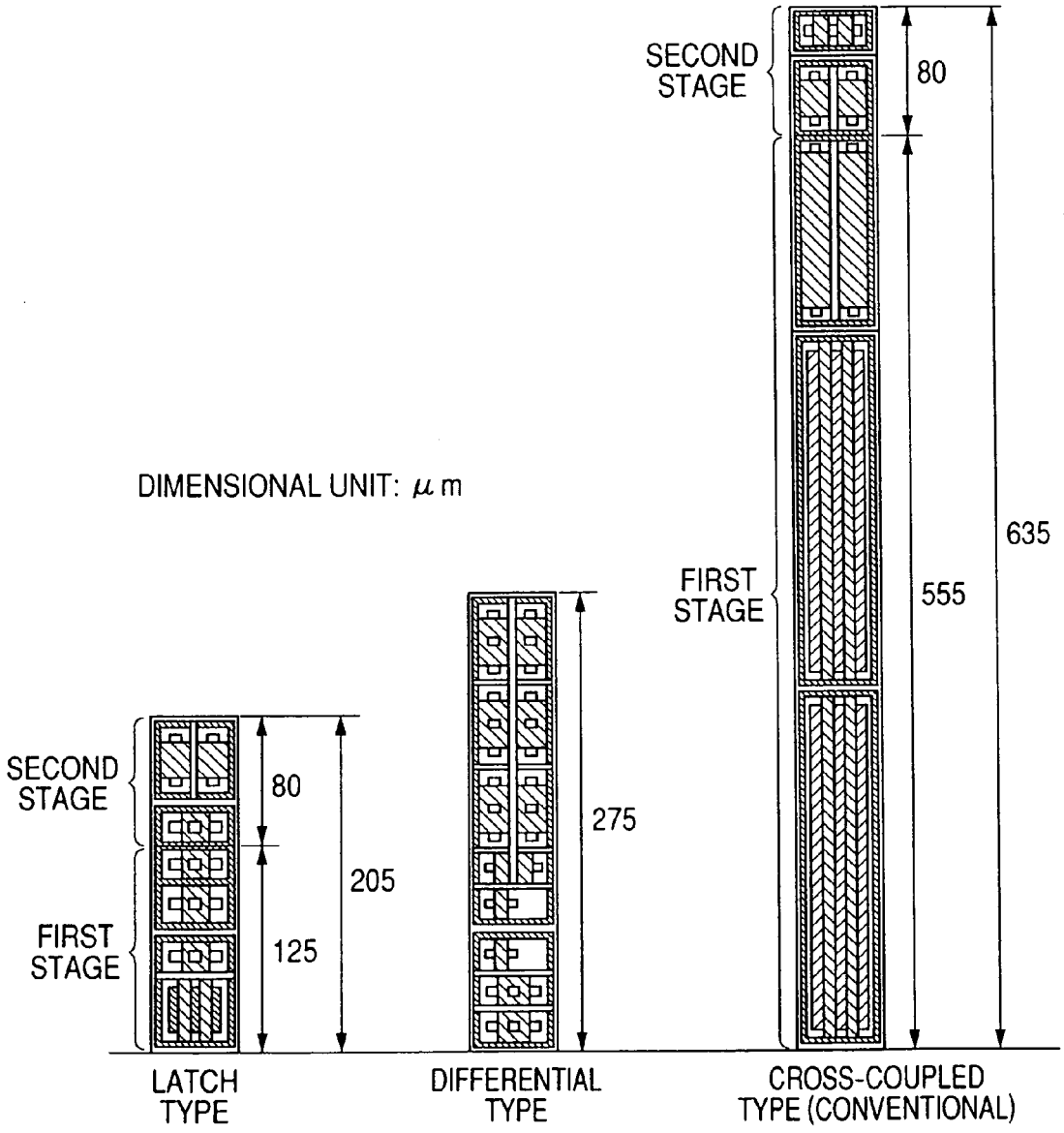
FIG. 39 is a schematic diagram showing an effect of embodiment 4.

FIG. 39 is a schematic diagram showing an effect of embodiment 4. FIG. 39 shows, from the left, dimensions of the level shifter circuit 303 according to embodiment 4, dimensions of the differential amplifier circuit, and dimensions of a conventional level shifter circuit.

The conventional level shifter circuit needs to increase the size of the MOS transistor so as to increase a flowing electric current. The first-stage cross-coupled circuit occupies a large area as shown in FIG. 39, for example. The level shifter circuit 303 according to embodiment 4 need not apply an electric current for inverting the MOS transistor and can miniaturize the first-stage latch circuit 303*a*. However, it is necessary to provide the voltage conversion circuit (differential amplifier circuit) to generate the high-withstand-voltage enable signals HENB and HENBN to be supplied to the latch circuit 303*a*.

As shown in FIG. 39, the sum of the vertical dimension (205 □m) of the level shifter circuit according to embodiment 4 and the vertical dimension (275 □m) of the voltage conversion circuit (differential amplifier circuit) can be smaller than the vertical dimension (635 □m) of the conventional level shifter circuit.

As mentioned above, the liquid crystal display apparatus according to embodiment 4 uses the level shifter circuit 303 constructed to include the first-stage latch circuit 303*a* and the second-stage cross-coupled circuit 303*b*. It is possible to decrease an area of the level shifter circuit 303 on a chip (driver IC).

While embodiment 4 uses the latch circuit 303*a* for the first-stage circuit, the other circuits may be used as long as the circuit construction can hold the input signal LVIN.

While embodiment 4 uses the latch circuit 303*a* at the first stage and the cross-coupled circuit 303*b* at the second stage, the invention is not limited thereto. For example, a latch circuit may be used at the second stage.

While embodiment 4 uses the voltage conversion circuit (differential amplifier circuit) as shown in FIG. 38 to generate the high-withstand-voltage enable signals HENB and HENBN to be supplied to the first-stage latch circuit 303*a*, the invention is not limited thereto. For example, a high-withstand-voltage signal may be directly supplied from outside the scanning driver.

While embodiment 4 gave the example of changing the construction of the level shifter circuit 303 in the conventionally constructed scanning driver, this construction may be combined with the construction described in embodiment 3.

While there have been described specific preferred embodiments of the invention, it is to be distinctly understood that the invention is not limited thereto but may be otherwise variously embodied within the spirit and scope of the invention.

What is claimed is:

1. A display apparatus comprising:

a display panel having a plurality of gate lines and a plurality of drain lines arranged in a matrix;

a scanning driver for outputting a scanning signal to each gate line;

a data driver for outputting a display data signal to each drain line; and a display control circuit for controlling a timing to output a scanning signal from the scanning driver and a timing to output a data signal from the data driver, wherein the data driver includes:

a data latch circuit for temporarily holding display data;

a first latch circuit for holding display data supplied from the data latch circuit in a time-sharing manner until display data is accumulated to become large enough for one horizontal synchronization period;

a second latch circuit for holding display data large enough for the one horizontal synchronization period;

a level shifter circuit for receiving display data held in the second latch circuit and converts a signal level of the display data;

a decoder circuit for generating an analog signal corresponding to the display data signal level converted in the level shifter circuit;

an output circuit for amplifying an analog signal generated in the decoder circuit;

a switch circuit for outputting an analog signal amplified in the output circuit to a drain line; and a horizontal synchronization signal delay circuit for dividing the plurality of drain lines into a plurality of groups of bundles of drain lines and shifting a timing to transfer the display data for each group of bundles of drain lines when the second latch circuit transfers the display data to the level shifter, and wherein the second latch circuit comprises a latch circuit and a multiplexer circuit, and wherein the horizontal synchronization signal delay circuit includes a delay circuit for the latch circuit of the second latch circuit and a delay circuit for the multiplexer circuit.

2. The display apparatus according to claim 1, wherein the horizontal synchronization signal delay circuit gradually delays a timing to transfer the display data from one of the plurality of groups of bundles of drain lines near a center of the drain lines along an arrangement direction to one of the plurality of groups of bundles of drain lines at an end of the drain lines along the arrangement direction.

3. A display apparatus comprising:

a display panel having a plurality of gate lines and a plurality of drain lines arranged in a matrix;

a scanning driver for outputting a scanning signal to each gate line; a data driver for outputting a display data signal to each drain line; and a display control circuit for controlling a timing to output a scanning signal from the scanning driver and a timing to output a data signal from the data driver, wherein the data driver includes:

a data latch circuit for temporarily holding display data;

a first latch circuit for holding display data supplied from the data latch circuit in a time-sharing manner until display data is accumulated to become large enough for one horizontal synchronization period;

a second latch circuit for holding display data large enough for the one horizontal synchronization period;

a level shifter circuit for receiving display data held in the second latch circuit and converts a signal level of the display data;

a decoder circuit for generating an analog signal corresponding to the display data signal level converted in the level shifter circuit;

an output circuit for amplifying an analog signal generated in the decoder circuit;

a switch circuit for outputting an analog signal amplified in the output circuit to a drain line; and a horizontal synchronization signal delay circuit for dividing the plurality of drain lines into a plurality of blocks and shifting a timing to transfer the display data for each block when the second latch circuit transfers the display data to the level shifter, wherein the second latch circuit comprises a latch circuit and a multiplexer circuit, and wherein the horizontal synchronization signal delay circuit includes a delay circuit for the latch circuit and a delay circuit for the multiplexer circuit.

* * * * *